US008458937B2

(12) United States Patent
Fritsche et al.

(10) Patent No.: US 8,458,937 B2
(45) **Date of Patent: *Jun. 11, 2013**

(54) TRADESHOW DISPLAY FORMED OF BANNER STANDS

(75) Inventors: Mark A. Fritsche, Eagan, MN (US); Dan D. Berg, St. Paul, MN (US); Jason W. Johnson, Minneapolis, MN (US); John T. Elliott, Eagan, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/165,449

(22) Filed: Jun. 21, 2011

(65) Prior Publication Data

US 2012/0073172 A1 Mar. 29, 2012

Related U.S. Application Data

(63) Continuation of application No. 12/042,213, filed on Mar. 4, 2008, now Pat. No. 7,963,059, which is a continuation-in-part of application No. 11/000,855, filed on Dec. 1, 2004, now Pat. No. 7,337,567.

(51) Int. Cl.
*G09F 17/00* (2006.01)

(52) U.S. Cl.
USPC ..... 40/603; 40/607.04; 40/606.12; 40/610; 40/605

(58) Field of Classification Search
None
See application file for complete search history.

(56) References Cited

U.S. PATENT DOCUMENTS

| | | | |
|---|---|---|---|
| 516,018 | A | 3/1894 | Lauer |
| 565,192 | A | 8/1896 | Waterhouse |
| 1,071,158 | A | 8/1913 | Hurlbut |
| 1,330,447 | A | 2/1920 | Pech |
| 1,700,637 | A | 1/1929 | Lamb |
| 2,498,855 | A | 2/1950 | Hutt |
| 2,855,241 | A | 10/1958 | Walter |
| 3,069,198 | A | 12/1962 | Winn |
| 3,075,805 | A | 1/1963 | Golde et al. |
| 3,092,174 | A | 6/1963 | Winn |
| 4,658,560 | A | 4/1987 | Beaulieu |

(Continued)

FOREIGN PATENT DOCUMENTS

| | | |
|---|---|---|
| WO | WO 00/47508 | 8/2000 |
| WO | WO 01/35381 A1 | 5/2001 |
| WO | WO 01/91092 A1 | 11/2001 |

OTHER PUBLICATIONS

Banner Lite™, Portable Display Systems, Radius® Portable Display Systems, Hanna Design, undated, 4 pages.

(Continued)

*Primary Examiner* — James Kramer
*Assistant Examiner* — Christopher E Veraa
(74) *Attorney, Agent, or Firm* — Thomas J. Oppold; Larkin Hoffman Daly & Lindgren, Ltd.

(57) ABSTRACT

A banner stand having an upright display mode and a collapsed transport mode, the banner stand comprising a banner presenting graphics thereon, a base and a post extending upwardly from the base, a support member selectively operably coupleable with the post to support the banner in an upright display mode, feet selectively changeable from a transport position to a operative position have an exposed alignment surface that cooperates with another such alignment surface on an adjacent banner stand to angularly and positionally control the respective banner stands to position as desired the respective banners. Tops of the banner stands may be coupled, such as by magnets, to further support and control the spacing and positioning of the banners.

15 Claims, 44 Drawing Sheets

U.S. PATENT DOCUMENTS

| | | | |
|---|---|---|---|
| 4,700,498 | A | 10/1987 | Perutz et al. |
| 5,067,546 | A | 11/1991 | Jeuffray et al. |
| 5,647,154 | A | 7/1997 | Groves |
| 5,787,621 | A | 8/1998 | Leksell |
| 5,798,861 | A | 8/1998 | Doat |
| 6,079,474 | A | 6/2000 | Lin |
| 6,115,951 | A | 9/2000 | Jing et al. |
| D468,362 | S | 1/2003 | Zarelius |
| 6,546,990 | B2 | 4/2003 | Peeters |
| 6,571,496 | B2 | 6/2003 | Zarelius |
| 6,659,159 | B2 | 12/2003 | Fritsche et al. |
| 6,676,205 | B2 | 1/2004 | Lin |
| 6,873,458 | B1 | 3/2005 | Bakkom et al. |
| 7,040,372 | B2 | 5/2006 | Johansson et al. |
| 7,163,044 | B2 | 1/2007 | Kirby |
| 7,203,000 | B2 | 4/2007 | Kotera |
| 7,237,350 | B1 | 7/2007 | Zarelius |
| 7,337,567 | B2 | 3/2008 | Fritsche et al. |
| 2002/0050083 | A1 | 5/2002 | Zarelius |
| 2003/0116997 | A1 | 6/2003 | Lin |

OTHER PUBLICATIONS

Plex Banner Stands, Medway Photographic Ltd., www.medway-displays.co.UK/banner-stands.htm, undated, 2 pages.

Innovative Banner Stands, Evan Evans Group, www.evanevans.com.au/pdf/innovativebannerstands.pdf, undated 2 pages.

Application and File History of U.S. Appl. No. 11/926,949, Inventor Mark A. Fritsche et al., filed Oct. 29, 2007.

Application and File History of U.S. Appl. No. 11/000,855, Inventor Mark A. Fritsche et al., filed Dec. 1, 2004 (now U.S. Patent7,337,567, issued Mar. 4, 2008).

Application and File History of U.S. Appl. No. 12/042,213, Inventor Mark A. Fritsche et al., filed Mar. 4, 2008 (now U.S. Patent7,963,059, issuing Jun. 21, 2011).

Anonymus: "ULTIMA displays online catalogue" Internet Article, [Online] May 25, 2004, XP002522803 Retrieved from the Internet: URL:http://web.archive.org/web/20040525042830/http://www.swcl.co.uk/swcl2002/downloads/ultima.pdf> [retrieved on Apr. 6, 2009] See "uno boomerang" the curved banner stand.

TRADESHOW DISPLAY FORMED OF BANNER STANDS

RELATED APPLICATIONS

This application is a continuation of U.S. patent application Ser. No. 12/042,213, filed Mar. 4, 2008, issuing Jun. 21, 2011 as U.S. Pat. No. 7,963,059, which is a continuation-in-part of U.S. patent application Ser. No. 11/000,855, filed Dec. 1, 2004, issued Mar. 4, 2008 as U.S. Pat. No. 7,337,567, which applications are hereby fully incorporated herein by reference.

FIELD

The present invention relates generally to tradeshow displays. More particularly, the embodiments of the present invention relate to tradeshow displays formed of banner stands.

BACKGROUND

Trade show displays are often collapsible and can be easily transported and erected. Such displays can also divide spaces and present visual graphics for viewing by attendees. One pleasing aspect of such displays is the ability to provide some depth, such as providing a smooth-flowing, curved display surface. One structure used at trade shows includes a network of support rods that expand into a volumetrically substantial three-dimensional space. Such expanded structures can then be covered with sheet material capable of supporting graphics.

Other types of collapsible displays include banner stands. These stands are often used in reception areas, trade shows, museums, art exhibits, academic and research society meetings, advertising displays, and other areas in which visual information is temporarily displayed. To give the retractable banner stands depth, those using the banner stands can arrange and connect a series of banner stands to form a volumetrically substantial three-dimensional display. When arranged in this manner, the series creates a multi-faceted display, each facet containing a portion of an overall display. Currently, adjacent banner stands with angular positioning and spacing between stands generally rely on manual adjustment of individual display units dependant upon visual perceptions. There is a need for a more reliable and precise positioning means.

BRIEF SUMMARY

In an aspect, a banner stand can include upright display collapsed transport modes, the banner stand including a banner presenting graphics thereon, a base and a post extending upwardly from the base, a support member selectively operably coupleable with the post to support the banner in an upright display mode, a curved form selectively changeable from a first configuration into a curved configuration to selectively impart a curve to the banner when the banner is in the upright display mode, and a means for positioning the banner stand with a second banner stand when placed adjacent thereto. The means may include a magnet configured for selectively magnetically coupling and the banner stand with the second banner stand. The means may include feet having a transport position and a operating position with the operating position having a surface engageable with a foot of a similar adjacent banner stand to optimally position the adjacent stands. Such means can angularly, in the horizontal plane, position the adjacent banner stands with respect to one another. Additionally such means can space the banner stands, particularly the banner portions, with a defined visual gap extending the a vertical length therebetween.

In another aspect, a tradeshow display can include a first banner stand including a banner presenting graphics thereon, a base and a post extending upwardly from the post, a support member selectively operably coupleable with the post to support the banner in an upright display mode, a curved form selectively changeable from a first configuration into a curved configuration to selectively impart a curve to the banner when the banner is in the upright display mode, and a magnet. The tradeshow can further include a second banner stand including a second banner presenting graphics thereon, a second base and a second post extending upwardly from the second base, a second support member selectively operably coupleable with the second post to support the second banner in an upright display mode, a second curved form selectively changeable from a first configuration into a curved configuration to selectively impart a curve to the second banner when the second banner is in the upright display mode, wherein the magnet is configured for selectively magnetically coupling the first banner stand with the second banner stand when placed adjacently thereto.

In a further aspect, a method of providing a tradeshow display and instructions therefor can include providing a banner stand including a banner presenting graphics thereon, a base and a post extending upwardly from the base, a support member selectively operably coupleable with the post to support the banner in an upright display mode, a curved form selectively changeable from a first configuration into a curved configuration to selectively impart a curve to the banner when the banner is in the upright display mode, a magnet configured for selectively magnetically coupling the banner stand with a second banner stand when placed adjacently thereto. The method can further include providing instructions to selectively change the curved form from the first configuration into the curved configuration to selectively impart the curve to the banner when the banner is in the upright display mode and selectively place the banner stand adjacently to the second banner stand such that the banner stand and the second banner stand are magnetically coupled.

In yet another aspect, a banner stand having an upright display mode and a collapsed transport mode can include a banner having graphics thereon, the banner having a first side margin and a second side margin opposed the first side margin, a base and a post extending upwardly from the base, a support member selectively operably coupleable with the post to support the banner in an upright display mode, and a magnet presented proximate a top of the banner stand when in the upright display mode and extending beyond the first side margin, the magnet configured for selectively magnetically coupling the banner stand with a second banner stand, the second banner stand including a second banner having a pair of opposed side margins, such that when the banner stand is magnetically coupled with the second banner stand, one of the pair of opposed side margins of the second banner stand is maintained adjacent to and at a predetermined distance from the first side margin to create a visibly-recognizable separation between the banner and the second banner.

DETAILED DESCRIPTION OF THE DRAWINGS

Figure 1:
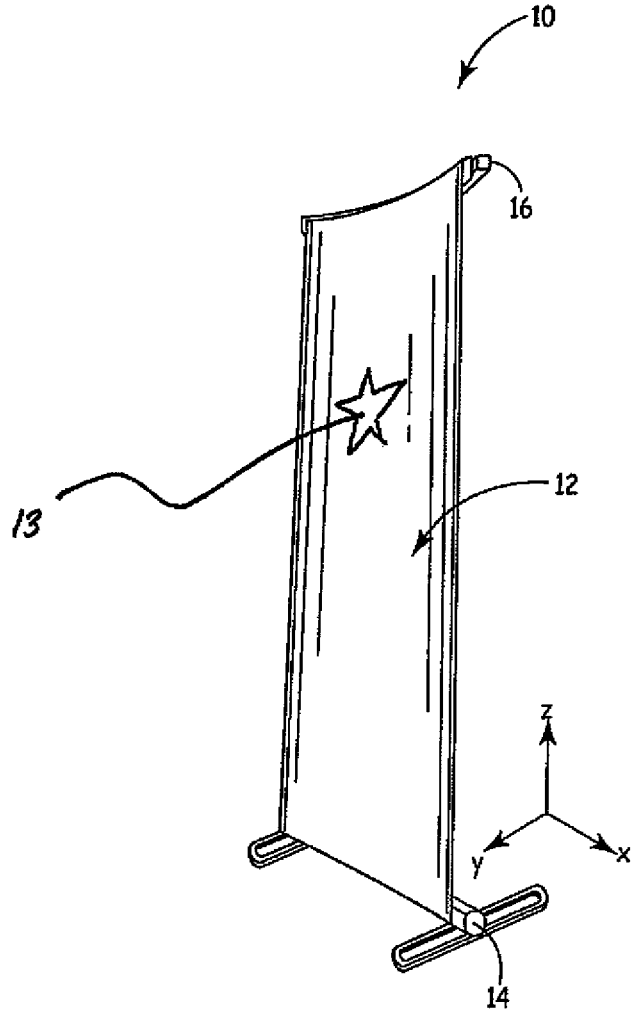
FIG. 1 is a front perspective view of a retractable banner stand according to a first embodiment depicting a banner, base, and cross member.
Figure 2:
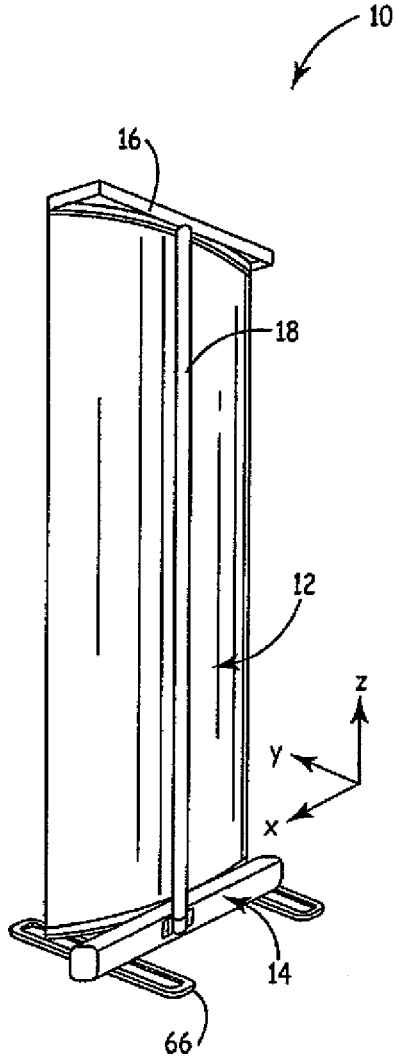
FIG. 2 is a rear perspective view of the retractable banner stand of FIG. 1, further depicting a post.

As can be seen in FIGS. 1-2, a retractable banner stand 10 generally comprises a banner 12 having graphics 13, a base 14, and a post 18 (FIG. 2) having a cross member 16 thereon. While the retractable banner stand 10 in FIGS. 1-2 is depicted in a fully dispensed or erected, upright mode, a retractable banner stand 10 in a fully retracted or collapsed transport mode can be seen in FIGS. 6-7.

Figure 3:
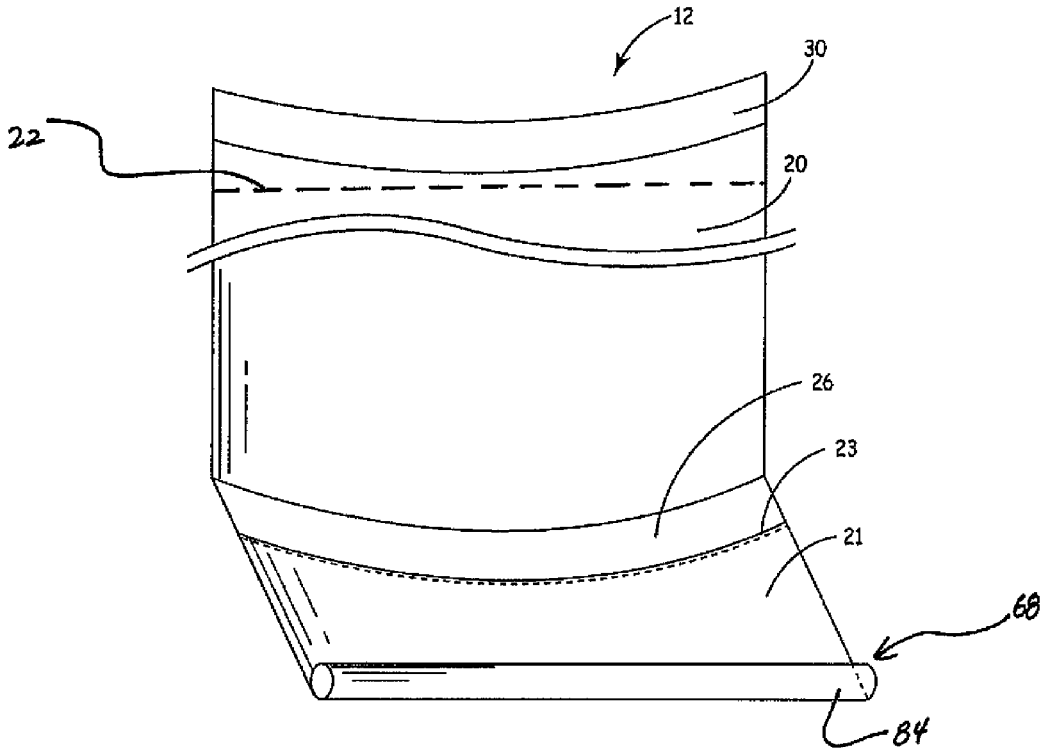
FIG. 3 is a bottom fragmentary rear perspective view of a banner of a retractable banner stand.
Figure 4:
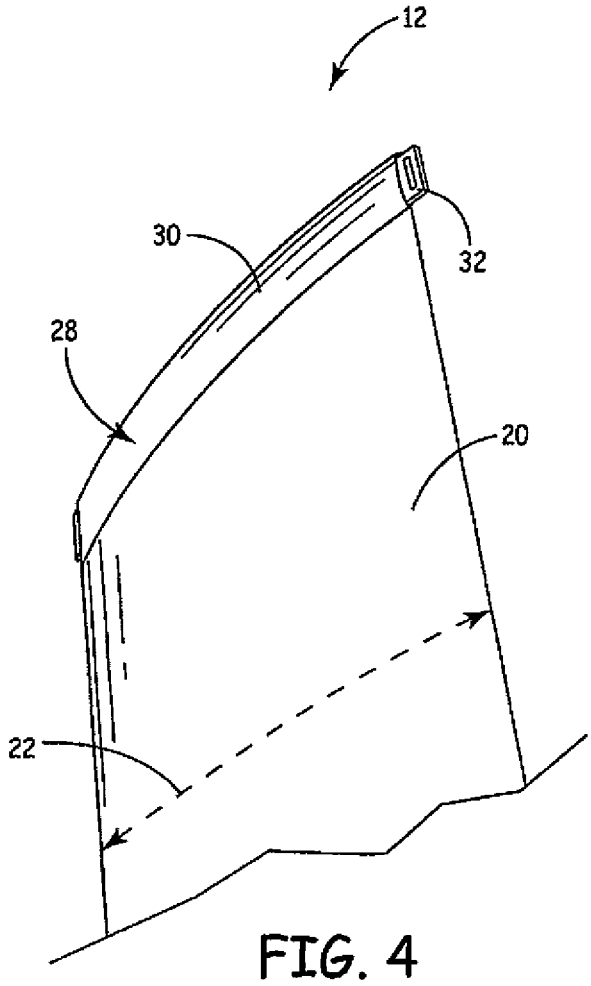
FIG. 4 is a top fragmentary rear perspective view of the banner of FIG. 3.
Figure 5:
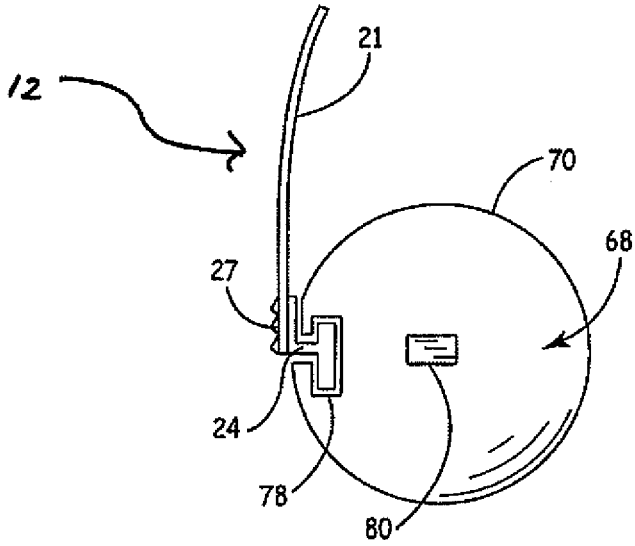
FIG. 5 is a close-up side elevation view of a core of a retractable banner stand having a banner coupled thereto.

As depicted in FIGS. 3-5, the banner 12 can comprise a sheet 20 having a banner width 22, a leader or lead-in portion 21 connected to a bottom end 26 of the sheet 20 at a junction 23, an exchange member 24 connected to the leader 21 opposite the junction 23, and a header 28 located on the sheet 20 opposite the bottom end 26. The banner 12 can further include a pocket 30 proximate the header 28 and a top strip 32 slidably engaging and fitting within the pocket 30.

The sheet 20 can be fabricated using a flexible-foldable material such poplin, but can also be made out a number of materials including, but not limited to, various textiles, polyplastic, and LYCRA®. The leader 21 can be fabricated using a stretchable material such as LYCRA®, but can be made out a number of materials. The leader material can be more stretchable than the banner material by more than 20% and has a warp stretch between 135 and 165 at 30 lbs The leader material can include a side stretch between 70 and 90 at 30 lbs. These stretch values are obtained using a stretch test performed per ASTM D4964. While the banner 12 can comprise a stretchable leader 21, it is contemplated that the sheet 20 be fabricated using a stretchable material such as LYCRA®, the sheet being connected to the exchange member 24 at the bottom end 26, thus eliminating the need for a leader 21. While the sheet 20 can be made out a stretchable material such as LYCRA®, those skilled in the art recognize that it can be made out of a number of other materials. The exchange member can be constructed of plastic, but can be made out of, for example, steel, extruded aluminum, or other materials. While the exchange member 24 as depicted in FIG. 5 is connected to the leader 21 using stitches 27, the exchange member 24 can be connected to the sheet 20 by any number of mechanisms, including, but not limited to, tape, rivets, staples, or screws.

Figure 6:
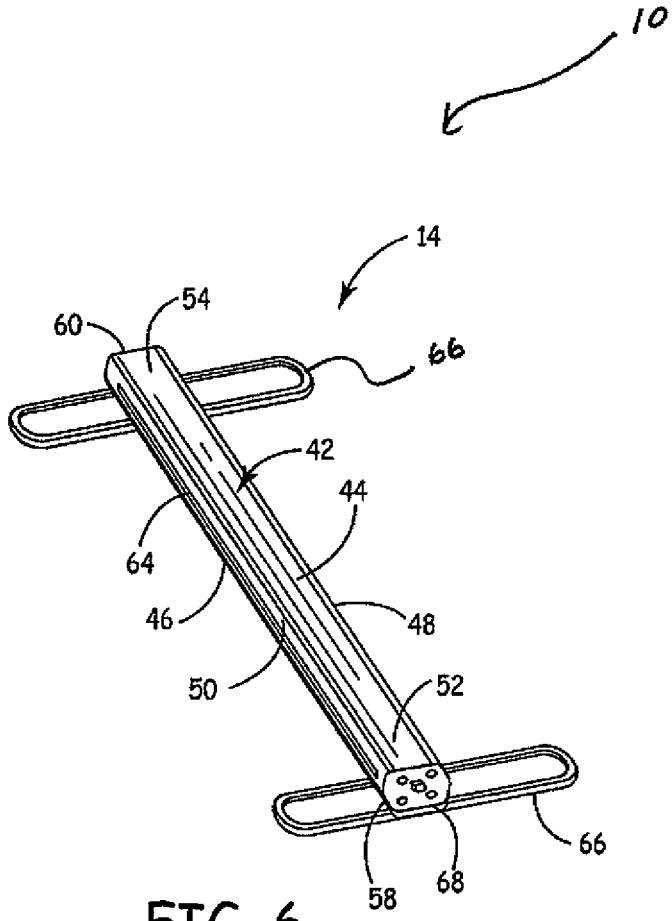
FIG. 6 is a rear perspective view of the base of the retractable banner stand of FIG. 1, depicting feet in an open configuration.
Figure 7:
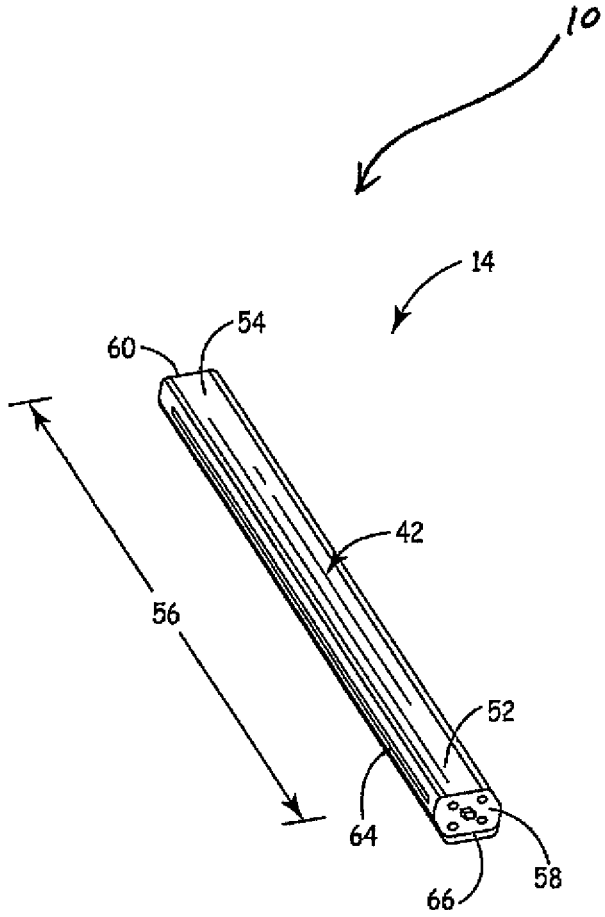
FIG. 7 is a front perspective view of the base of the retractable banner stand of FIG. 1, depicting the feet in a closed configuration.
Figure 10:
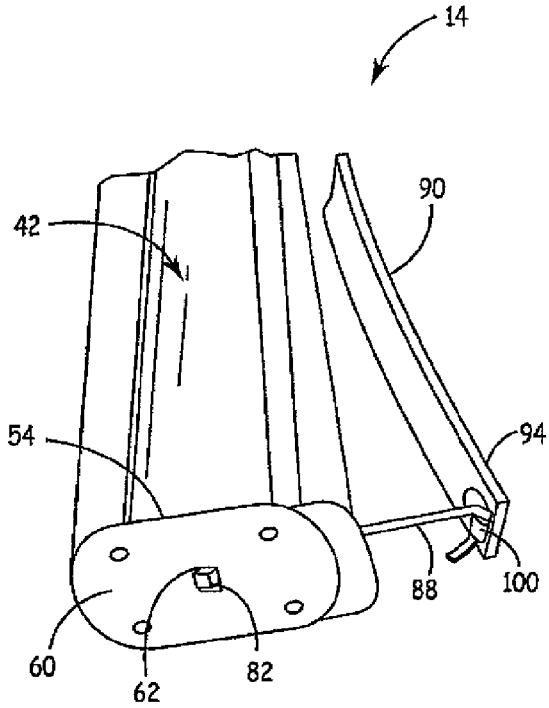
FIG. 10 is a close-up fragmentary side perspective view of a base of a retractable banner stand.

As depicted in FIGS. 6-7, the base 14 can comprise a housing 42 comprising a top 44, a bottom 46, a front 50, and a rear 48. The housing 42 further comprises a first housing end 52 and a second housing end 54, the distance between the housing ends 52, 54 defining a housing width 56 (FIG. 7). The housing 42 is enclosed at the first housing end 52 by a first plate 58 and at the second housing end 54 by a second plate 60, the plates 58, 60 being connected to the housing 42 using screws. Alternatively, the plates 58, 60 can be connected to the housing 42 using bolts, rivets, snaps, or weldaments. As can be seen in FIG. 10, the plates 58, 60 each can include a tab aperture 62. The housing 42 further includes a banner slot 64 extending substantially from the first housing end 52 to the second housing end 54. The housing can be constructed of extruded aluminum, but can be made out a number of materials including, but not limited to, sheet metal or various polymers.

The base 14 can comprise at least one foot 66 for stabilizing the retractable banner stand 10. As depicted in FIG. 7, when the retractable banner stand 10 is not in use and in a fully retracted position, the at least one foot 66 is arranged so that it is substantially parallel the housing 42. Once the retractable banner stand 10 is in use and in a dispensed position, the at least one foot 66 is arranged so that it is substantially perpendicular the housing 42, as depicted in FIG. 6. In this position, the at least one foot 66 gives stability to the retractable banner stand 10. The feet 66 contact the floor surface or tabletop surface. Such feet can be removable or pivotal for folding up the base for transportation and storage. The at least one foot 66 can be snapped, pivoted, or slid onto the ends 52, 54 of the housing 42.

Figure 8:
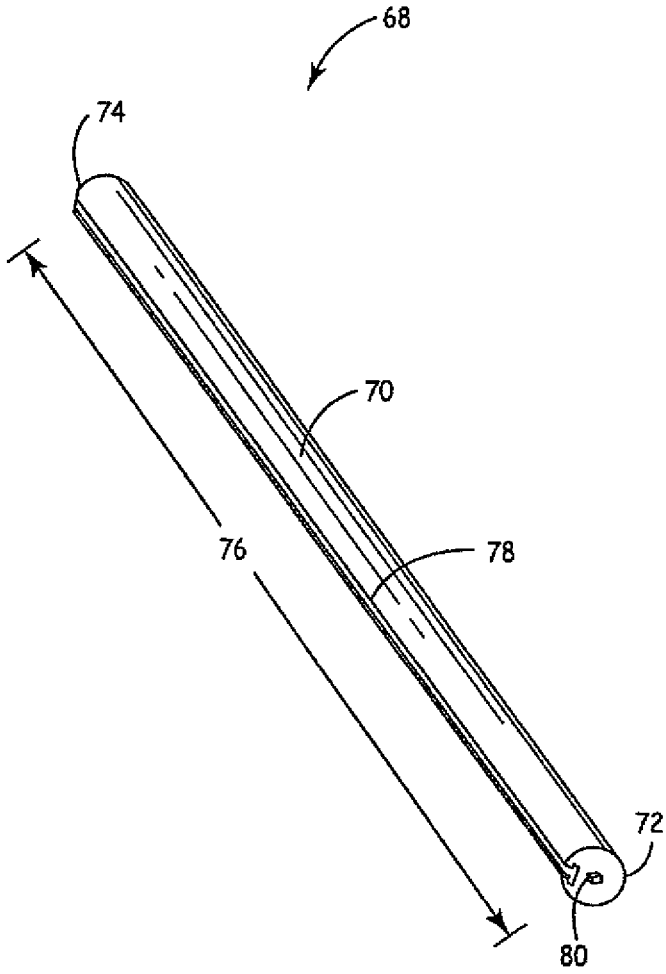
FIG. 8 is a perspective view of the core of FIG. 5.

The base 14 further comprises a retractor mechanism 68 as depicted in FIGS. 5 and 8. The retractor mechanism 68 can comprise a core 70, a first retractor end 72, and a second refractor end 74, the distance between the ends defining a retractor width 76. The retractor mechanism can be spring loaded and utilizes componentry not shown herein in detail but well known in the art. See, for example, U.S. Pat. No. 6,571,496 incorporated herein by reference in its entirety. The retractor width 76 can be substantially equal to the housing width 56 and slightly larger than the banner width 22. The core 70 comprises a channel 78 can extend from the first retractor end 72 to the second retractor end 74. The retractor mechanism 68 also can comprise a first tab 80 extending beyond the first retractor end 72 and a second tab 82 extending beyond the second retractor end 74. The tabs 80, 82 can be slightly smaller in size than the tab aperture 62.

As depicted in FIG. 5, the leader 21 or sheet 20 can be connected to the retractor mechanism 68 by first slidably engaging the exchange member 24 with the channel 78. Once the exchange member 24 engages the channel 78, the sheet 20 can then be wound onto the core 70 creating a banner roll 84 (FIG. 3), which has a round profile. The channel 78 can comprise a retaining feature to retain the exchange member 24 from slipping out of the core 70 when there is no load on the retractor 68. It is also contemplated that the bottom end 26 of the banner includes an exchange member made of the leader 21. The leader 21 would slidably engage with the channel 78 in order to connect the banner 12 to the retractor 68 in an alternative manner.

The leader 21 can be connected directly to the core 70. The banner 12 can comprise an exchange member 24 having a first exchange member portion and a second exchange member portion. The first exchange member portion is connected to the leader 21 opposite where the leader 21 is connected to the core 70. The second exchange member portion is connected to the sheet 20 opposite the header 28. When one using the retractable banner stand 10 desires to change the sheet 20, she simply slides apart the two exchange member portions and inserts a new sheet 20 having a second exchange member portion. Once sheet 20 has been rolled into the banner roll 84, the banner roll 84 can be placed through an access aperture located on at least one of the first plate 58 or second plate 60 and positioned inside of the housing 42 until the first tab 80 slidably engages with the tab aperture 62 on the plate opposite the plate in which the access aperture is located. Once the first retractor end 72 abuts the plate, the access aperture is enclosed so that the second tab 82 is captured by the tab aperture 62 on the plate comprising the access aperture.

If at least one of the first plate 58 or second plate 60 does not include an access aperture, the housing 42 can include an access door on the top 44, bottom 46, front 50, or rear 48 in which the banner roll 84 can be inserted into the housing 42. When the banner roll 84 is placed into the housing 42, the sheet 20 is positioned such that header 28 is located outside of the housing 42 while the remainder of the banner roll 84 is located within the housing 42. By being larger than the banner slot 64, the top strip 32 can inhibit the header 28 from being wound onto the banner roll 84 once the banner roll 84 is inserted into the housing 42. The retractor 68 can further comprise a winding mechanism for winding and unwinding the banner 12 with respect to the core 70. Such a winding mechanism is shown and described in PCT Publication No. WO 00/47508, which is incorporated herein by reference in its entirety.

Because a retractable banner stand 10 can include an access aperture or other access door, users can change the a banner 12 on a banner roll 84 without having to remove or move anything on the base 14, with the exception of the retractor 68. This enables users to quickly change any graphics on the retractable banner stand 10 if they desire doing so.

When one desires to use the retractable banner stand 10, the post 18 and cross member 16 can be assembled and connected before the banner 12 can be dispensed. The post 18 is first connected to the housing 42 intermediate the first housing end 52 and second housing end 54 such that the post 18 is perpendicular the housing 42. The cross member 16 is then connected to the post 18 so that the cross member 16 is generally perpendicular to the post 18 and substantially parallel to the housing 42. While the post 18 can be made of an integral, unitary section, it is contemplated that the post 18 comprises more than one section so that it can be adjusted in height and can be disassembled. In addition, while the post 18 and cross member 16 can be separate but connectable, it is contemplated that the post 18 and cross member 16 be connected using a pin or hinge (not depicted in figures). Once the post 18 is connected to the housing 42, the cross member 16 can be rotated or hinged so that it is perpendicular to the post 18. Once the post 18 and cross member 16 are assembled and connected, the banner 12 can be dispensed from the refractor 68 until the top strip 32 or header 28 can be connected to the cross member 16. The top strip 32 or header 28 can be connected to the cross member 16 using a hook, snap, magnetic strips, screws, bolts, slot & groove, or hook and loop material such as VELCRO®.

Figure 9:
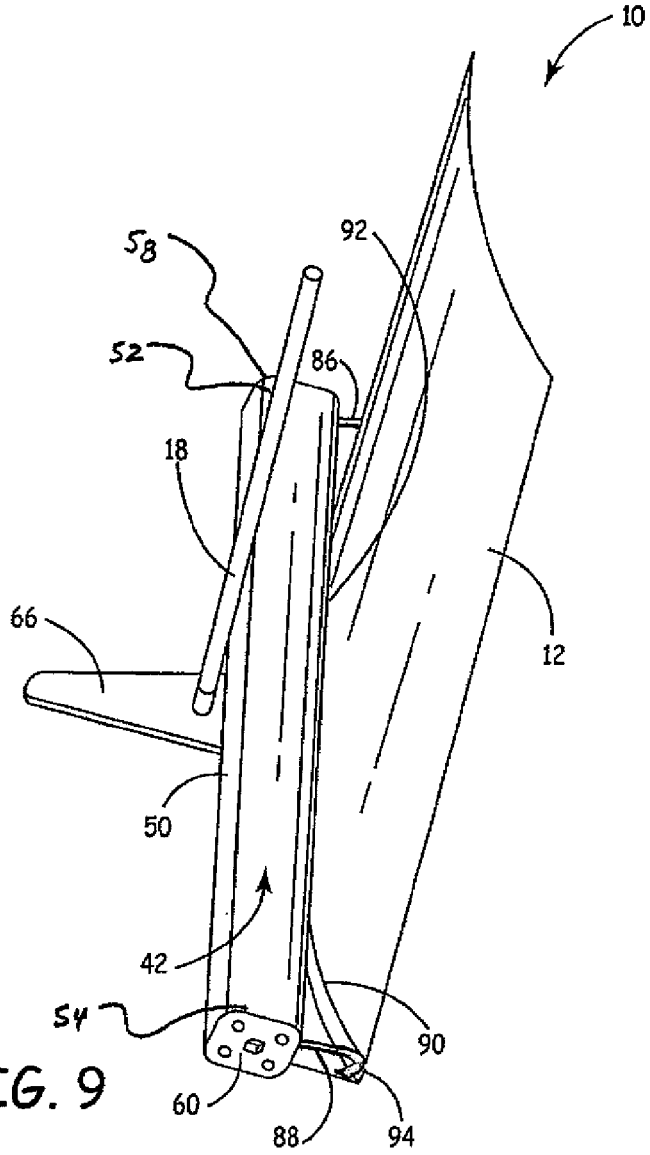
FIG. 9 is a fragmentary rear perspective view of a retractable banner stand according to a second embodiment.
Figure 11:
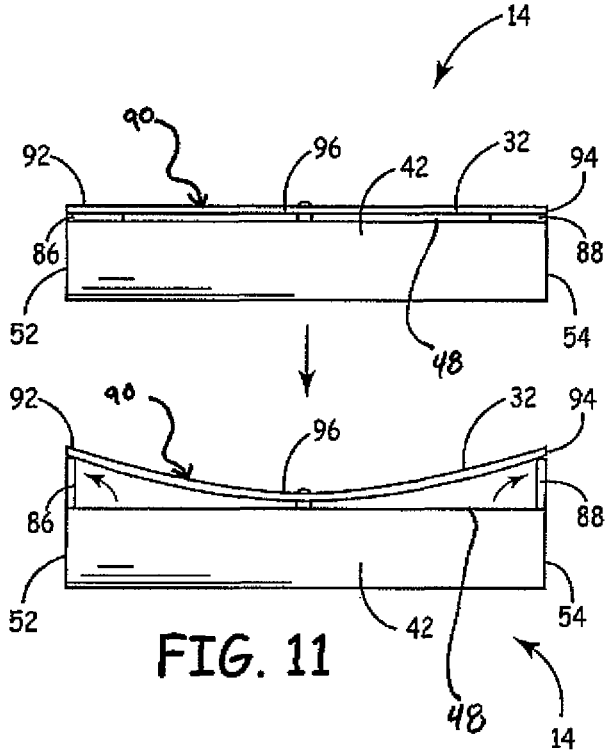
FIG. 11 is a top view of the base of a retractable banner stand depicting a mechanism for providing curvature to the banner according to a first embodiment.

The retractable banner stand 10 comprises various curved forms and curvature mechanisms for providing curvature to the banner 12. As depicted in FIGS. 9-11, a retractable banner stand 10 comprises a first base spacer 86 hingedly connected to the housing 42 proximate the first housing end 52 and a second base spacer 88 hingedly connected to the housing 42 proximate the second housing end 54. Alternatively, the first base spacer 86 can be hingedly connected to the first plate 58 and the second base spacer 88 hingedly connected to the second plate 60. The base 14 can comprise a base strip 90 comprising a first strip end 92, second strip end 94, and base strip center 96. Also, the base strip center 96 can be connected to the front 48 of the housing 42 intermediate the first plate 58 and second plate 60.

The base strip 90 can comprise a cross-section with a greater dimension in a first plane and a lesser dimension in a second plane that is perpendicular to the first plane. The greater dimension can be at least four times the lesser dimension whereby the base strip 90 is more readily flexible in the plane of the lesser dimension and wherein the plane of the lesser dimension is substantially horizontal when the retractable banner stand 12 is erected into the upright mode. While the base strip 90 has been described as having a greater dimension in a first plane and a lesser dimension in a second plane that is perpendicular to the first plane, the base strip can also be a rod, cylinder, or wire.

Referring to FIG. 11, when the banner 12 is in a fully retracted position, the base spacers 86, 88 can be folded inward towards a position intermediate the first housing end 52 and second housing end 54 so that the base spacers 86, 88 abut the housing 42. When the base spacers 86, 88 are in this position, the base strip 90 is in a non-use position and remains unstressed and is in a substantially un-flexed shape.

When the banner 12 is in a fully dispensed position, as depicted in FIG. 9, the base spacers 86, 88 can be displaced hingedly outward to a position substantially perpendicular with the front of the housing 48. Once the base spacers 86, 88 are in this position, the first base spacer 86 engages a first eyelet 98 connected to the first base strip end 92 and the second base spacer 88 engages a second eyelet 100 connected to the second base strip end 94. Because the base strip center 96 can be connected to the housing 42, the base strip 90 is in a curved use position and is given a flexed, curved shape or form, as can be seen in FIG. 9. Alternatively, the base spacers 86, 88 can slide into a slot in the base housing 42 and then be connected to the slot in the base housing 42. Alternatively, the base spacers 86, 88 can hinge downwardly or upwardly to a position generally perpendicular with the front of the housing 48.

Figure 17:
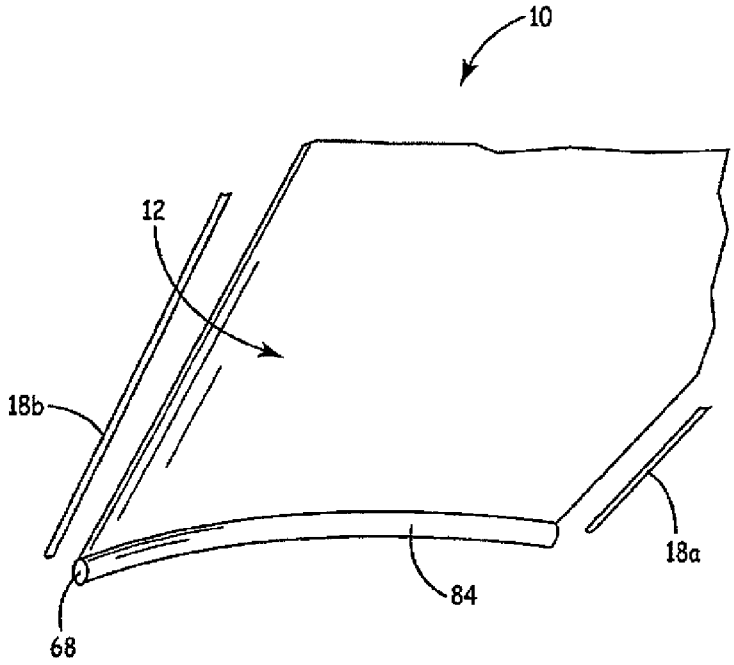
FIG. 17 is a fragmentary bottom rear perspective view of a banner.
Figure 27:
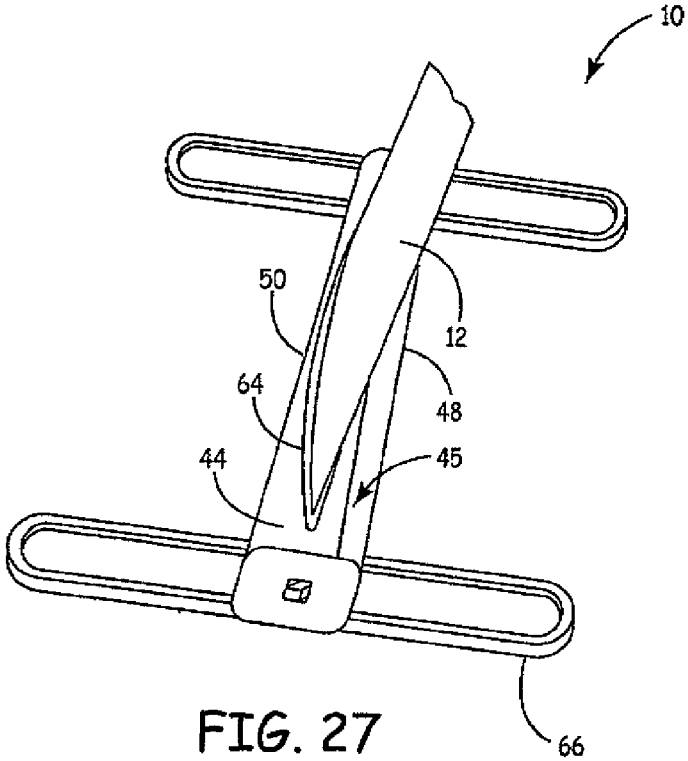
FIG. 27 is a fragmentary bottom rear perspective view of a retractable banner stand.
Figure 30:
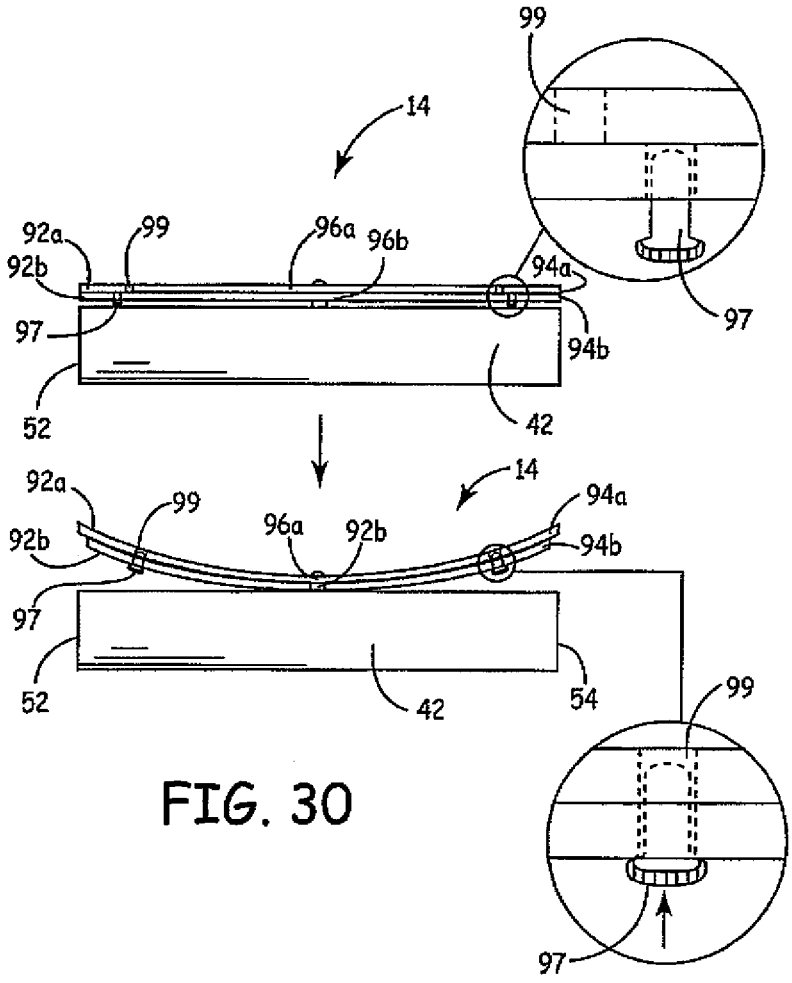
FIG. 30 is a top view of the base of a retractable banner stand depicting a mechanism for providing curvature to the banner according to a fifth embodiment.

As depicted in FIG. 30, the mechanism for imparting a curve on a banner is similar to a "leaf-spring" mechanism. The base strip 92 comprises a first base strip member 92*a* and a second base strip member 92*b*. When the second base strip member 92*b* is given a flexed shape, it slides along and imparts a curve on the first base strip 92*a*. In order to retain the first base strip member 92*a* and second base strip member 92*b* in the flexed shape, the base strip 92 can comprise tabs 97, on the second base strip member 92*b*. Once the first and second base strips member 92*a*, 92*b* are given the flexed shape, the tabs 97 will engage with apertures 99 that are included on the first base strip member 92*a*. Alternatively, the tabs 97 can be included on the first base strip member 92*a* and the apertures 99 on the second base strip member 92*b*. When the tabs 97 engage with the apertures 99, the first and second base strip members 92*a*, 92*b* are retained in the flexed shape. To remove the first and second base strip members 92*a*, 92*b* from the flexed shape, the tabs 97 are disengaged with the apertures 99 so that the first and second base strip members 92*a*, 92*b* can return to an un-flexed shape. The tabs 97 can include biasing mechanisms such as a spring so that they are biased towards the aperture 99 or can alternatively frictionally fit within the second base strip member 92*b* and manually slide into the aperture 99. As depicted in FIG. 27, the banner slot 64 is generally curved and is located on the top, of the housing 42. When the banner 12 is retracted from the retractor mechanism 68, the slot 64 imparts a curve on the banner 12. While the retractor mechanism 68 might not be curved, it is contemplated that the retractor mechanism 68 be curved as depicted in FIG. 17.

Figure 12:
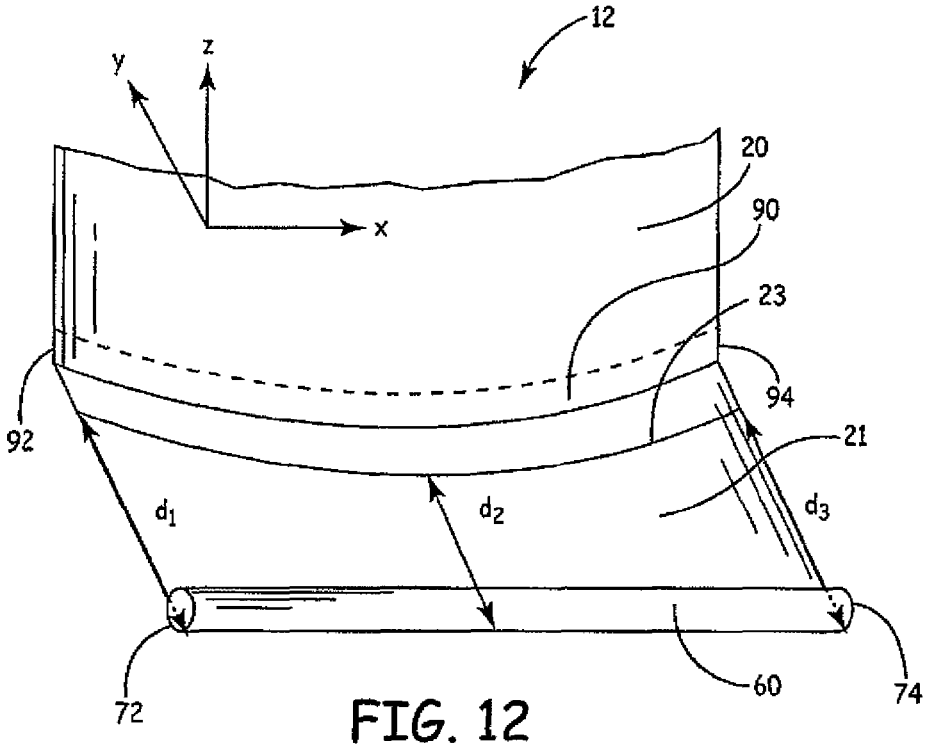
FIG. 12 is a bottom fragmentary rear perspective view of a banner stand according to a first embodiment.
Figure 13:
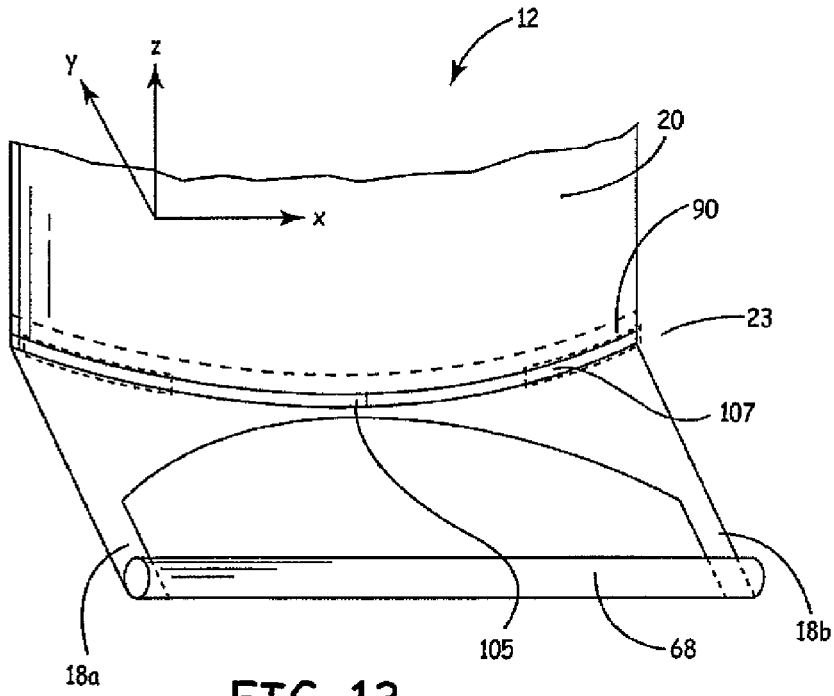
FIG. 13 is a bottom fragmentary rear perspective view of a banner according to a second embodiment.

When it is given a flexed, curved shape, the base strip 90 then imparts a curve on the sheet 20. As depicted in FIGS. 12-13, which include x-y-z axes imposed on the figures, the stretchable leader 21 is stretched in different amounts about the z-axis, in the x-y plane, depending on the portion of the leader 21. For example, when the base strip 90 is given a flexed, curved shape, the leader material located between the first base strip end 92 and first retractor end 72 (labeled as dl), and the leader material located between the second base strip end 94 and the second retractor end 74 (labeled as d3) are stretched and stressed more along the y-axis direction than the leader material between the base strip center 96 and the retractor center 75 (labeled as d2). By using stretchable material to construct the leader 21, the leader 21 absorbs and deflection and stress created by the flexed, curved base strip 90 and the sheet 20 remains largely unaffected. This inhibits the curved base strip 90 from creating any kinks or distortions on the sheet 20. The stretchable material can extend across the entire width of the leader and for appropriate compensation of the stresses; the length of the leader material can appropriately be in a "concave" curve facing the erected banner as shown by the junction 23 between the graphic display portion of the banner and the leader portion. Alternatively, as depicted in FIG. 13, the leader 21 can comprise a two leader portions, 18*a*, 18*b*. In some embodiments, it is optional to construct the leader portions using a stretchable material. The sheet 20 can be constructed using a stretchable material. The leader 18 can be optional in this configuration.

As illustrated in FIG. 12, the flexible base strip can be permanently within the banner, such as by being sewn in or laminated therein. In such a case, it would be wound up on the core when the banner is retracted. FIG. 13 shows an alternative resiliently flexible rod 105 instead of the flexible strip, placed in a pair of pockets 107 in the banner. Such pockets can be configured to impart a stress to an otherwise straight rod to provide a curvature. For example, the distance between in inside ends of the pair of pockets can be less than the length of the un-flexed rod, whereby placement of the rod in the pockets imparts the curvature to the rod. Such a resiliently flexible rod can also be used at the top of the banner for providing curvature there.

Figure 14:
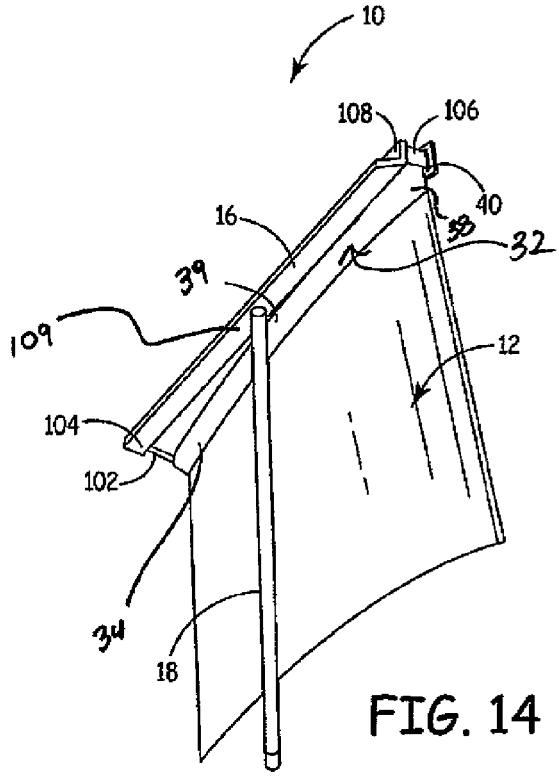
FIG. 14 is a fragmentary top rear perspective view of a retractable banner stand.

As depicted in FIG. 14, the retractable banner stand 10 can comprise a first header spacer 102 hingedly connected to a first mast end 104 and a second header spacer 106 hingedly connected to a second mast end 108. When the banner 12 is in a fully retracted position, the spacers 102, 106 can be folded inward towards a position intermediate the first mast end 104 and second mast end 108 so that the header spacers 102, 106 abut the cross member 16. When the header spacers 102, 106 are in this position, the top strip 32 remains unstressed and are in a substantially un-flexed position.

When the banner 12 is in a fully dispensed position, a header center 39 is connected to a mast center 109 using a hook, snap, rivet, or similar mechanisms. In order to connect the header center 39 to the mast center 109, there can be a cutout in the pocket (not depicted) providing access to the header center 39. In addition, once the top strip 32 is connected to the cross member 16, the header spacers 102, 106 can be hinged outward so that they are perpendicular with the cross member 16. Once the header spacers 102, 106 are in this position, the first header spacer 102 engages a third eyelet (not depicted) located on the first header end 34 and the second base spacer 106 engages an fourth eyelet 40 located on the second header end 38. Because the header center 39 is first connected to the mast center 109, the top strip 32 is then in given a flexed, curved shape or form, as can be seen in FIG. 14.

The top strip 32 can comprise a cross-section with a greater dimension in a first plane and a lesser dimension in a second plane that is perpendicular to the first plane. The greater dimension is at least four times the lesser dimension whereby the top strip 32 is more readily flexible in the plane of the lesser dimension and wherein the plane of the lesser dimension is substantially horizontal when the retractable banner stand 12 is erected into the upright mode. While the top strip 32 has been described as having a greater dimension in a first plane and a lesser dimension in a second plane that is perpendicular to the first plane, the base strip can be a rod, cylinder, or wire.

The cross member can be a rigid form and have the curvature mechanisms accomplished by simply utilizing a curved cross member and suitably attaching the top of the banner thereto.

Figure 15:
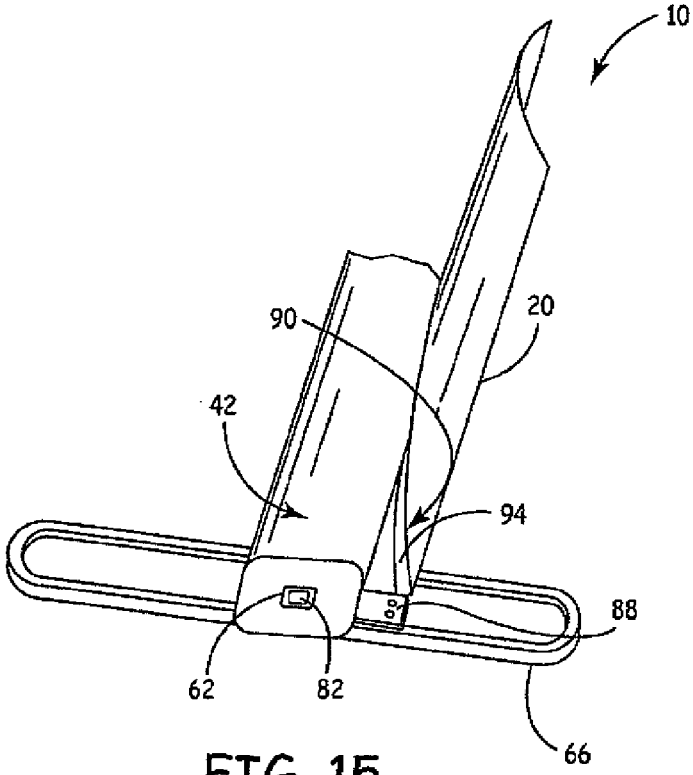
FIG. 15 is a fragmentary bottom rear perspective view of a retractable banner stand.
Figure 16:
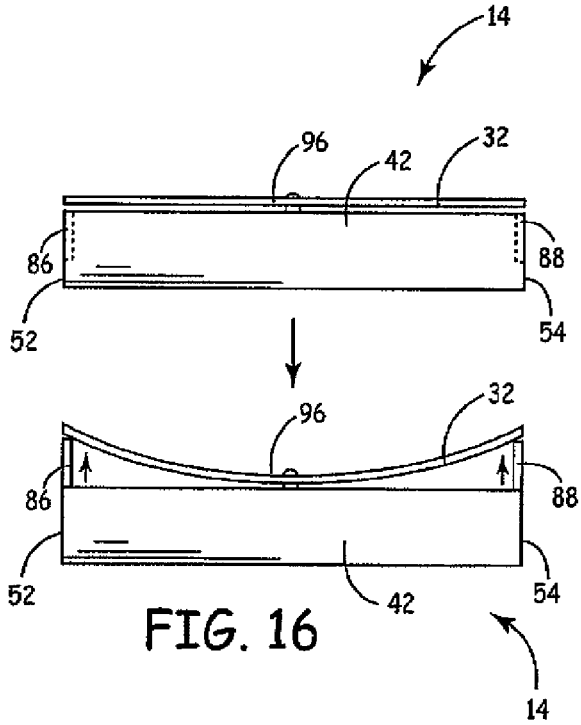
FIG. 16 is a top view of the base of a retractable banner stand depicting a mechanism for providing curvature to the banner according to a second embodiment.

As depicted in FIG. 15, the base spacers 86, 88 can be slidably connected to the housing 42 and fixedly connected to the base strip ends 92, 94. The base spacers 86, 88 are retained within the housing 42 or plates 58, 60 when a user does not wish in impart curvature to the banner 12 or while a user is dispensing the banner 12 from the retractor. When a user desires to impart curvature to the banner 12, the base spacers 86, 88 are released from the retained position and slid out into an extended position. The base spacers 86, 88 can then be locked in their extended position. Once the base spacers 86, 88 are in their extended positions, because the base strip center 96 can be connected to the housing 42, the base strip 90 is given in a flexed, curved shape, as can be seen in FIGS. 15 and 16.

As depicted in FIG. 17, the core 70 is made of a flexible material such that the retractor 68 can be flexed. Once the banner 12 is in a dispensed position, or while the banner 12 is being dispensed, the retractor 68 is flexed such that it imparts curvature to the banner 12. The banner 12 would optionally include the use of a leader. Because the entire retractor width 76 and banner width 22 are being curved, there would not be a significant amount of distortion due to the curvature. However, the banner 20 can be constructed of a stretchable material to compensate for any amounts of stress or distortion on the banner 12.

Figure 18:
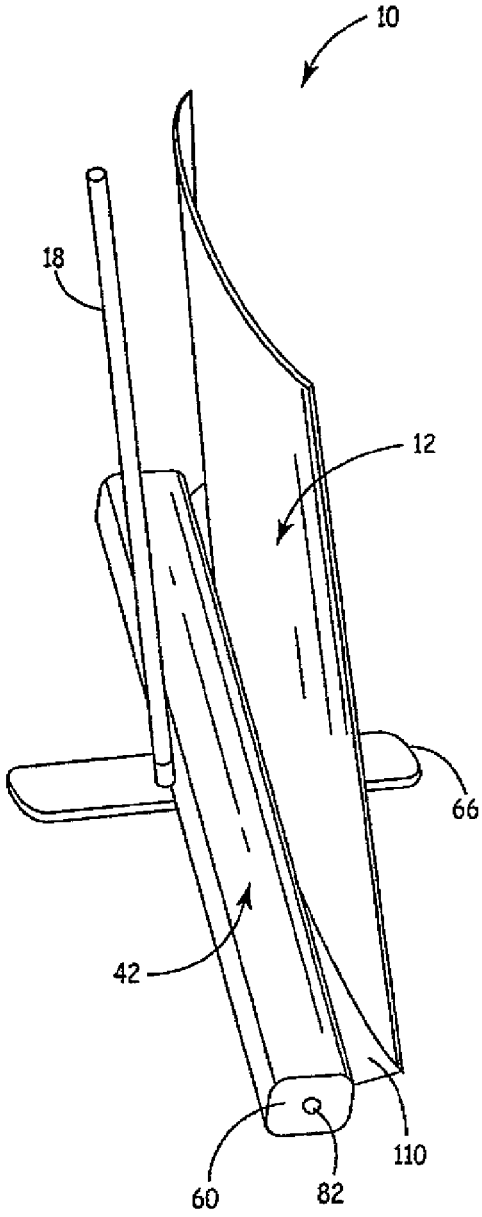
FIG. 18 is a fragmentary bottom rear perspective view of a retractable banner stand.
Figure 19:
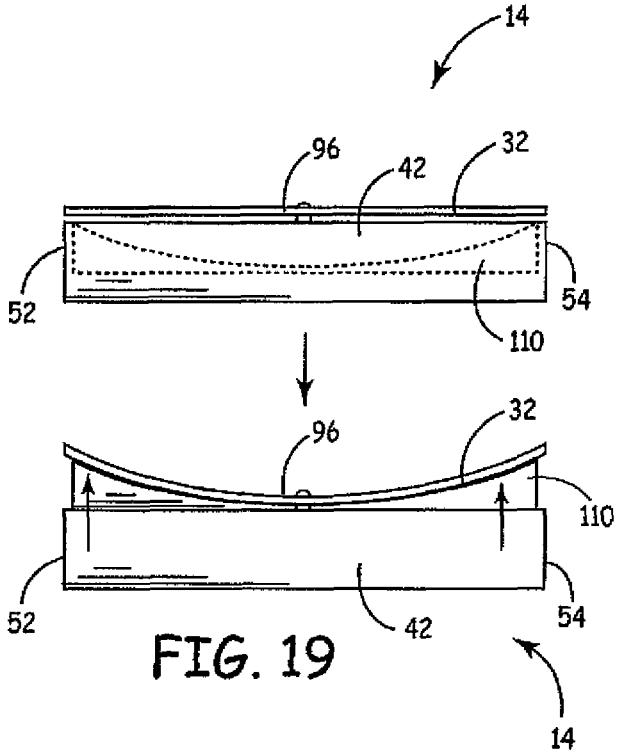
FIG. 19 is a top view of the base of a retractable banner stand depicting a mechanism for providing curvature to the banner according to a third embodiment.

As depicted in FIGS. 18-19, a base form 110 is slidably connected within the housing 42. Once the banner 12 has been dispensed from the retractor 68, the base form 110 can slide out of the housing 42. Once the base form has slid out of the housing, the general shape of the base form 110 is imparted on the banner 12 as it takes the general shape of the base form 110. For example, if the base form 110 has a curved shape, the banner 12 will take a generally curved shape. Alternatively, the base form 110 can be hinged or folded up against the housing 42 until the banner 12 is dispensed from the retractor 68. Once the banner 12 is fully dispensed, the base form 110 can be folded downwardly or upwardly so that it is substantially perpendicular with the housing 42. Once in this position, the general shape of the base form 110 would be imparted on the banner 12 as it takes the general shape of the base form 110.

Figure 20:
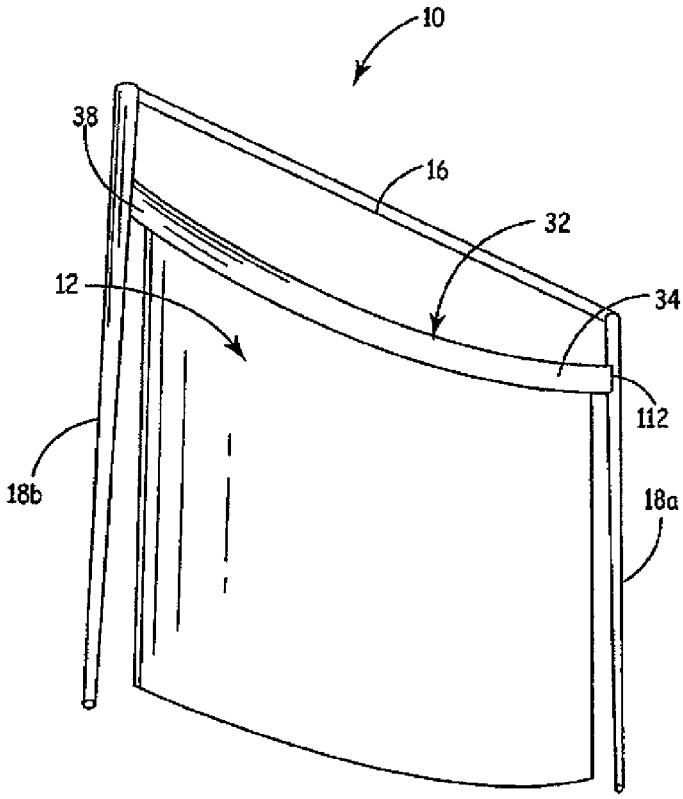
FIG. 20 is a fragmentary top rear perspective view of the retractable banner stand of FIG. 17.

Referring to FIG. 20, in any of the aforementioned embodiments, the top strip 32 can be connected on the outside of the header 28, as opposed to being slidably engaged within a pocket 30 as described in the aforementioned embodiments. Once the banner 12 is dispensed from the retractor 68, the first header end 34 and second header end 38 can slidably engage post slots 112 on a first post 18*a* and a second post 18*b*, the posts 18*a*, 18*b* being connected to the base 14 and cross member 16. Before the ends header ends 34, 38 can be inserted into the post slots 112, a user would impart a curve to the top strip 32 so that the distance between the header ends 34, 38 would be slightly less than the distance between the posts 18*a*, 18*b*. Once the distance between the header ends 34, 38 is slightly less than the distance between the posts 18*a*, 18*b*, the header ends 34, 38 can be inserted into the post slots 112. By doing this, the posts 18*a*, 18*b* would retain the curvature in the top strip 32 once the header ends 34, 38 are retained.

Figure 21:
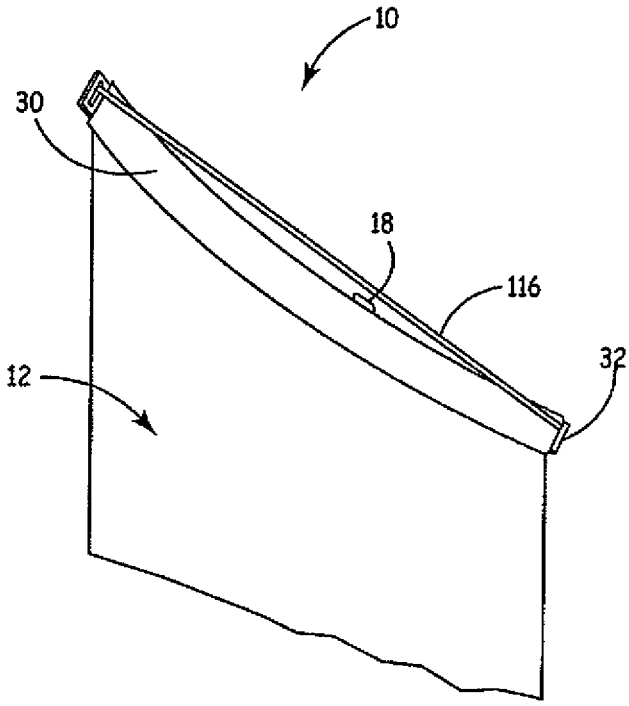
FIG. 21 is a fragmentary top rear perspective view of a retractable banner stand according to another embodiment.

As depicted in FIG. 21, the banner 12 can include a wire 116 connected to the top strip 32. Before the wire 116 is connected to the top strip, the top strip is flexed imparting a curve or bend in the top strip and then the wire 116 is connected to the first header end 34 and second header end 38, thus preserving the curve in the top strip 32. Once the banner 12 has been dispensed from the retractor 68, the header 28 or top strip 32 of the banner 12 can be connected to the mast center 109 using a hook, snap, rivet, or other suitable mechanisms.

Figure 22:
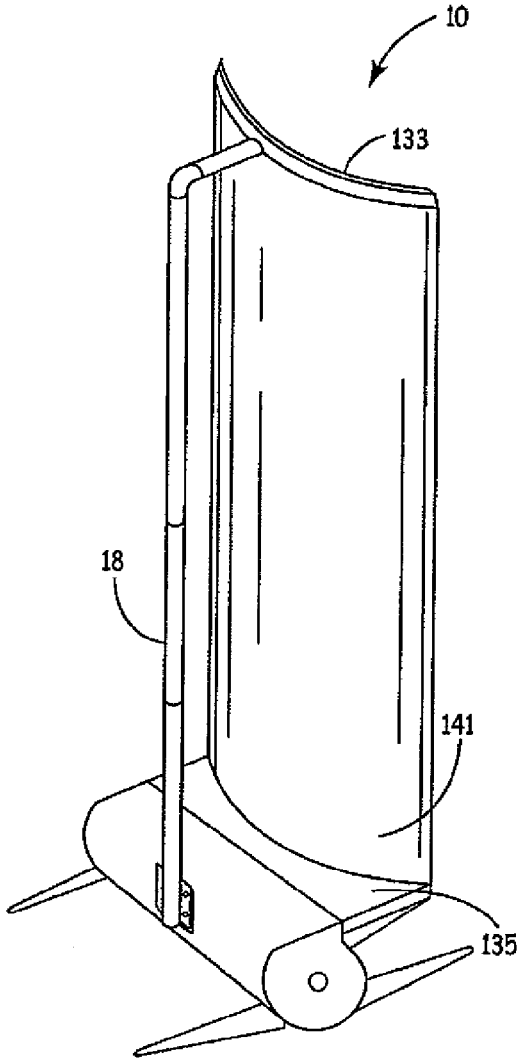
FIG. 22 is a rear perspective view of the retractable banner stand.

Referring to FIG. 22, the mechanism for providing curvature to the banner comprises rigid curved form 133 can be configured as the cross bar 133 and a rigid lower curved form 135. Both of these components, as well as the mast 18 can be separable from the other components and/or dissassembleable. The top 137 of the banner can be connected using attachment mechanisms 139 such as hook and loop material, magnetic strips, snaps, hooks or other known attachment mechanisms. The bottom 141 of the banner remains attached to the retractor mechanism, but can also be suitably secured to the lower curved form such as by magnetic strips or hook and loop material. Stretchable leader material can also be used. The leader material can be more stretchable that the material utilized for the banner.

Figure 25:
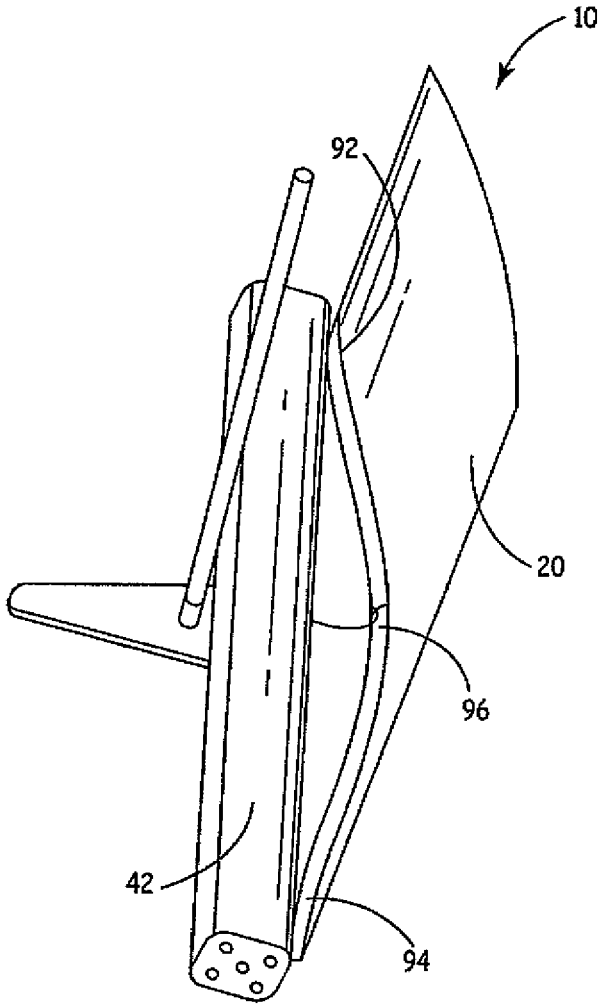
FIG. 25 is a fragmentary bottom rear perspective view of a retractable banner stand, depicting a central portion of a base strip having a curve imparted thereto.
Figure 26:
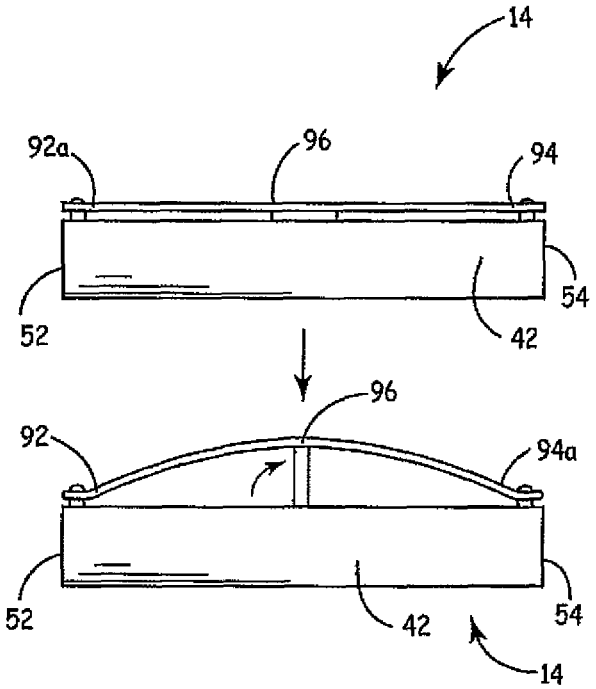
FIG. 26 is a top view of the base of a retractable banner stand depicting a mechanism for providing curvature to the banner according to a fourth embodiment.

The various embodiments of the retractable banner stand have been described as having a generally concave shape when viewing the banner from the front. Those of ordinary skill in the art would appreciate that the various embodiments can be easily modified so that the retractable banner stand has a generally convex shape when viewing the banner from the front. An example of such a banner can be seen in FIG. 25-26. The first strip end 92 and second strip end 94 of the base strip 90 can be connected to the front 48 of the housing 42 while the base strip center 96 remains unconnected. Any number of mechanisms, including those described in the present application, can be used to impart a curve on the base strip 90.

Figure 23:
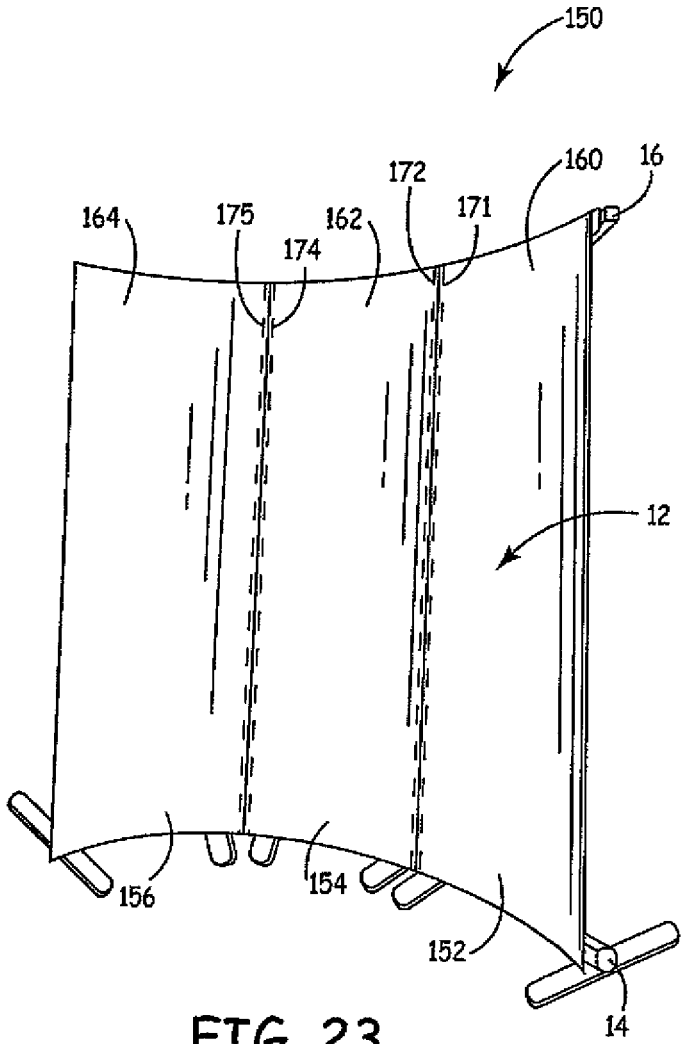
FIG. 23 is a perspective view of a plurality of retractable banner stands arranged in a series.

Referring to FIG. 23 a trade show display 150 comprises first, second and third retractable banner stand 152, 154, 156 abutting against and/or connected together. The three banner stands are in the erected upright mode as illustrated and the collapsed transport mode as previously described. The three stands have respective first, second, and third banners 160, 162, 164 and suitable mechanisms for providing curvature to the banners. The adjacent banner edges 171, 172, 174, 175 can be connected by magnetic strips in the respective banner edges or other connection mechanisms such as hook and loop material or the like. See International Publication WO 01/35381, disclosing connecting adjacent banners or screens. Said Publication is incorporated herein by reference.

Figure 28:
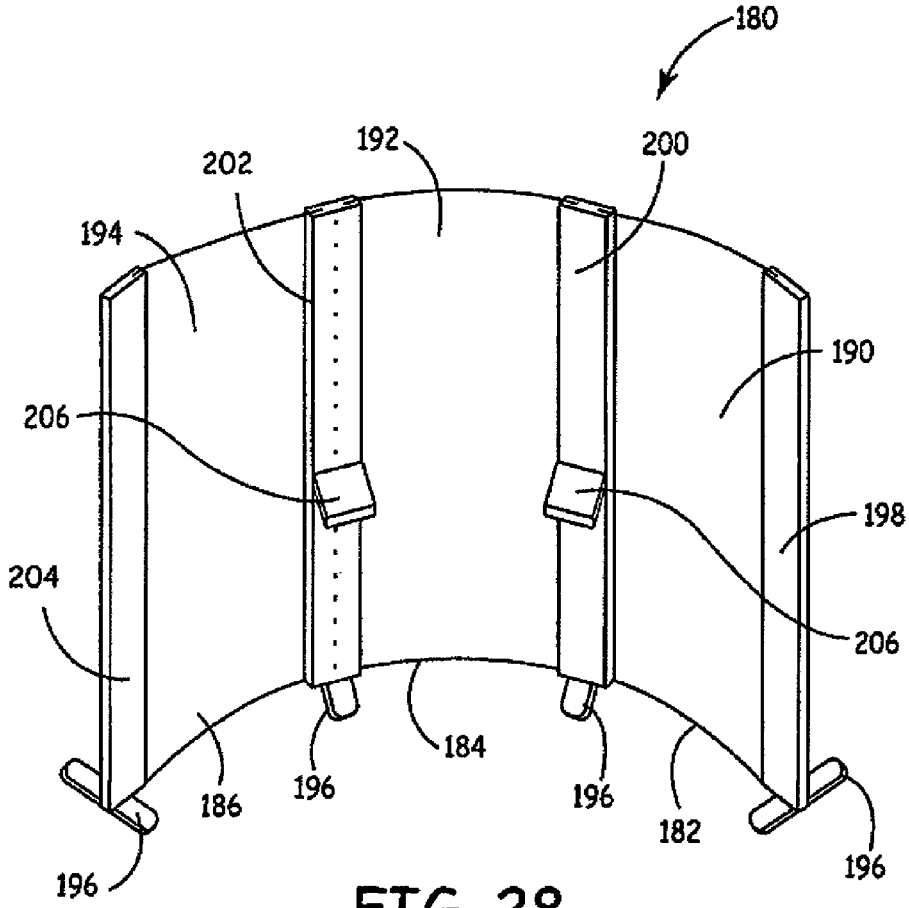
FIG. 28 is a perspective view of a plurality of retractable banner stands arranged in a series.
Figure 29:
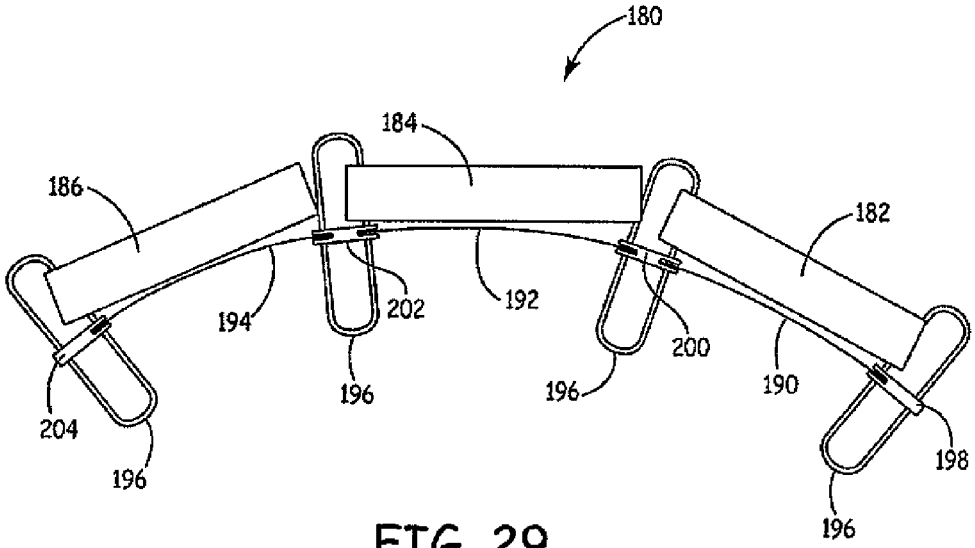
FIG. 29 is a top view of the series of FIG. 28.

If two or more of the retractable banner stands with curvature mechanisms are placed adjacent to one another, the banner stands can be connected so that the series of banners create a semicircle or arc. By doing so, the display can be continuous and smooth from one display banner to the next adjacent banner. Alternatively, one or more retractable banner stands with curvature mechanisms can be used in conjunction with one or more retractable banner stands without curvature mechanisms to create different shaped configurations. Referring to FIGS. 28-29, a tradeshow display 180 comprises a first, second and third retractable banner stand 182, 184, 186 abutting against and/or connected together. The three banner stands are in the erected upright mode as illustrated and the collapsed transport mode as previously described. The three stands have respective first, second, and third banners 190, 192, 194 and suitable mechanisms for providing curvature to the banners. Feet 196 are shared between adjacent retractable banner stands 10. Posts 198, 200, 202, 204 are then placed on the feet 196 shared between adjacent retractable banner stands. These posts 198, 200, 202, 204 then hide or cover the edges of the banner 190, 192, 194 and also offer product-holding capacity on a product-storing member 206. The product-storing member 206 can hold samples, brochures, business cards, flyers, or any other promotional materials. The product-holding member 206 can be connected to a post, which is then connected to the housing 42, the at least one foot 66 or the feet 196, or to any other portion of the retractable banner stand 10.

Posts 198, 200, 202, 204 are depicted as having a generally H-shaped cross section. However, posts 198, 200, 202, 204 can have round, square, rectangular, octagonal, or another geometric cross sectional shapes.

Figure 24:
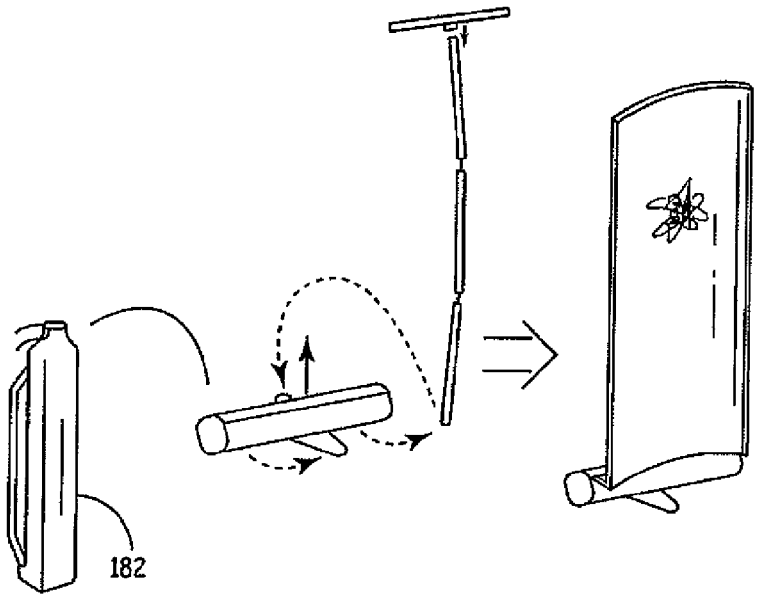
FIG. 24 is a schematic illustration depicting a banner stand in various stages of assembly.

Referring to FIG. 24, when the retractable banner stand 10 is in a fully retracted or collapsed transport mode, it can be placed into a carrying case or bag 182 for ease of storage and transport from a storage area to the place where it is to be dispensed and used for display. Basic steps in erecting a banner stand are described as follows. At the place the stand is to be set-up, the housing is removed from the bag or case; the mast, can be lodged within a recess or nesting area of the housing is removed and assembled; the foot or feet on the housing are pivoted to provide a secure base; the mast is inserted into a receiving hole on the housing; the banner is extended and attached at the top of the mast; the curvature mechanisms is actuated or attached. If there are two or more stands, they are appropriately positioned adjacent one another and attached such as by the edges of the banners and/or other suitable locations. Although various exemplary embodiments of the retractable banner stand have been described herein, numerous changes and variations can be made. For example, the mechanisms for providing curvature can provide a complex curve such as an S-shape in certain embodiments.

In certain embodiments, it can be desirable to operably couple two or more banner stands positioned adjacently to one another to create a display having some depth yet optionally include some spacing between banners to create a visual break therebetween.

Figure 31:
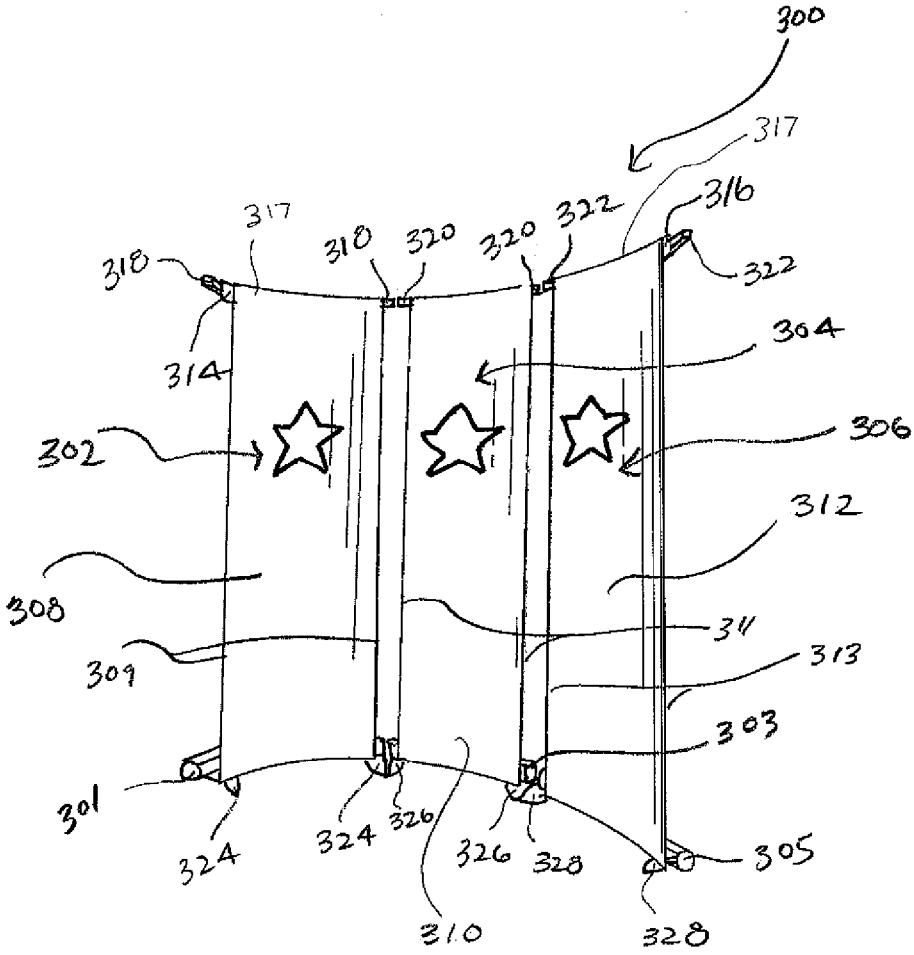
FIG. 31 is a perspective view of a plurality of retractable banner stands according to an embodiment arranged in a series, wherein the banner stands are each in a curved configuration.

Referring to FIG. 31, such a trade show display 300 comprises first, second, and third retractable banner stands 302, 304, 306 arranged in series. As illustrated, banner stands 302, 304, 306 are in an upright display mode. Banner stands 302, 304, 306 have respective bases 301, 303, 305 and respective first, second, and third banners 308, 310, 312. Referring again to FIG. 31, bases 301, 303, 305 can each include feet 324, 326, 328, respectively, for stabilizing banner stands 302, 304, 306 when in an erected upright mode. Banners 308, 310, 312 each include a pair side margins 309, 311, 313, respectively.

Figure 40:
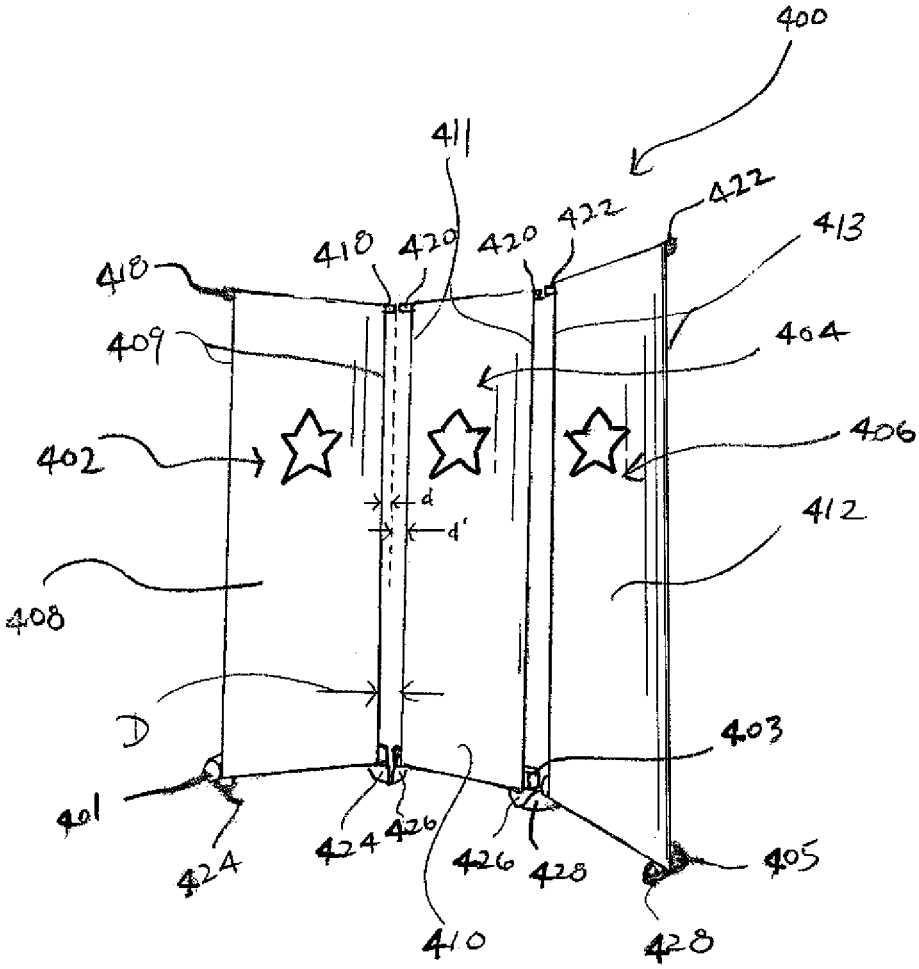
FIG. 40 is a perspective view of the plurality of retractable banner of FIG. 31 arranged in a series, wherein the banner stands are each in a non-curved configuration.

Banner stands 302, 304, 306 can each include one or more curved forms selectively changeable from a first configuration into a curved configuration to selectively impart a curve to banners 308, 310, 312 when banners 308, 310, 312 are in an upright display mode. Curved forms 314, 316 corresponding to first and third banner stands 302, 306, respectively, are depicted in FIG. 31, whereas curved form 315 (FIG. 32) corresponding to second banner stand 304 is behind banner 310 of second banner stand 304 in FIG. 31. Banner stands 302, 304, 306 in an uncurved configuration are depicted in FIG. 40.

Banner stands 302, 304, 306 each can comprise one or more magnet assemblies, such as presented proximate tops thereof when in an upright display mode for selectively magnetically coupling adjacent banner stands when placed adjacently to one another. Magnet assemblies 318, 320, 322 corresponding to first, second, and third banner stands 302, 304, 306, respectively, are depicted in FIG. 31.

Figure 32:
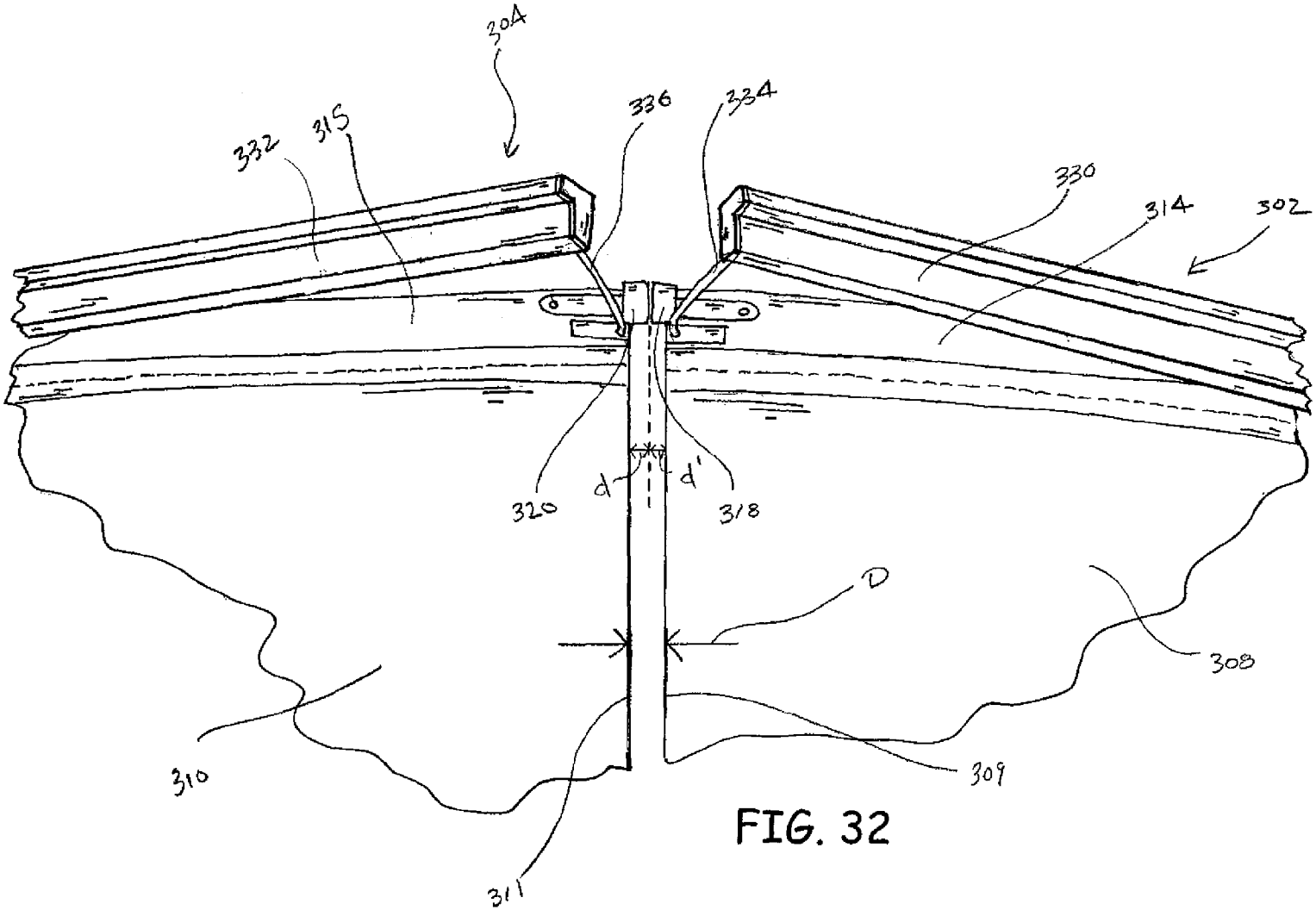
FIG. 32 is a close-up bottom perspective view of a connection system for arranging two retractable banner stands adjacent one another.

Referring to FIG. 32, first and second banner stands 302, 304 are depicted arranged in series, wherein banners 308, 310 are depicted in curved configurations. Specifically, curved forms 314, 315 are operably coupled to cross members 330, 332, respectively, such that spacers 334, 336 cause curved forms 314, 315 to be selectively changed from a first configuration into the curved configuration to selectively impart a curve to banners 308, 310 when banners 308, 310 are in an upright open position. Banner stands 302, 304 can then be arranged adjacently adjacently to one another using magnet assemblies 318, 320 to create an arc (FIG. 31). By doing so, display 300 can be continuous from one banner to the next adjacent banner and so on. Magnet assemblies 318, 320 can inhibit the separation of banner stands 302, 304 when bumped or otherwise moved or impacted.

Further, referring again to FIG. 32, magnet assemblies 318, 320 can create a visibly-recognizable separation between adjacent banners. To do this, magnets 318, 320 can extend beyond respective side margins 309, 311 by distances d, d', respectively. When banner stand 302 is magnetically coupled with banner stand 304 (and likewise banner stand 304 with banner stand 306), side margins 309 of banner 308 is maintained adjacent to and at a predetermined distance D from side margin 311 of banner 310 to create a visibly-recognizable separation between banner 308 and banner 310 (and likewise between banner 310 and banner 312). Distance D can be substantially a sum of distances d, d'.

Figure 33:
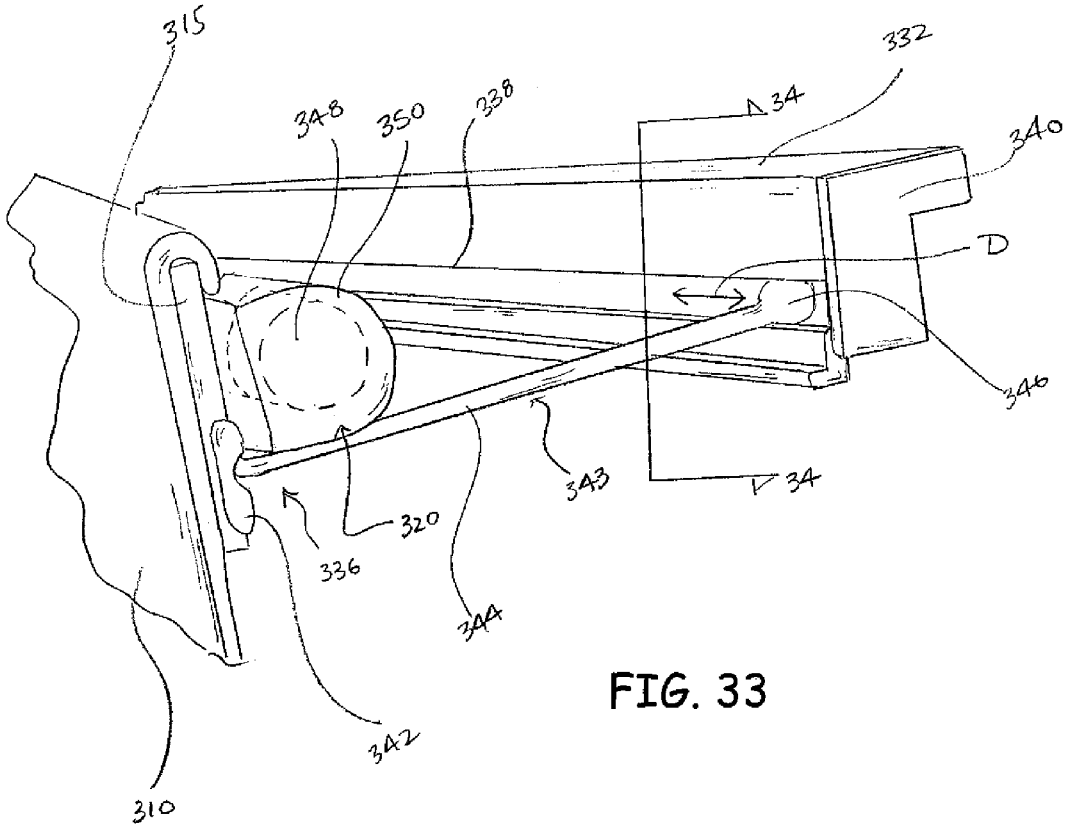
FIG. 33 is a close-up bottom perspective view of the connection system of FIG. 32.
Figure 34:
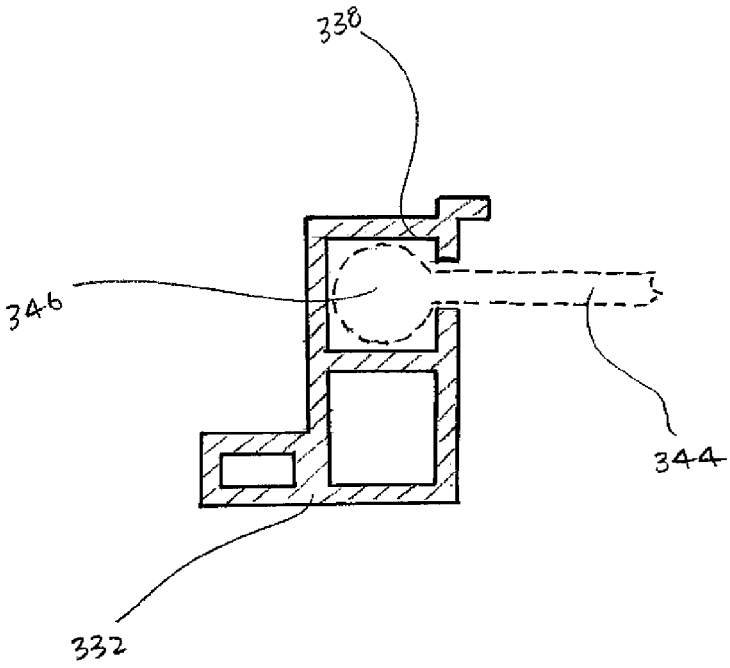
FIG. 34 is a cross-sectional view of a cross member taken along line 34-34 of FIG. 33, wherein a spacer is depicted in phantom lines.

Referring to FIGS. 33 and 34, further details of cross member 332, spacer mechanism 336, curved form 315, and magnet assembly 320 are depicted, including how curved form 315 can be selectively changed from a first configuration into a curved configuration to selectively impart a curve to a banner. Cross member 332 can comprise a channel 338 along a length thereof and one or more end caps 340 selectively presentable with ends of cross member 332, wherein end caps 340 can provide a termination or end point to channel 338. Spacer mechanism 336 can comprise a hinge portion 342 and a spacer portion 344, spacer portion 343 comprising an elongate member 344 and a ball 346 or other structure at an end of elongate member 344. Ball 346 is selectively slidable in channel 338 to enable curved form 315 to be selectively changed from a first configuration into the curved configuration.

Referring again to FIG. 32, magnet assembly 320 can comprise a magnet 348 (depicted in phantom lines) and a plastic housing 350 for magnet 348. To assembly magnet assembly 320, magnet can be inserted into a cavity in a back side of housing (not depicted) and a small cap can then be glued or otherwise fastened to cover cavity. In an embodiment, magnet can be a Grade MGOe 35, pressure-formed (sintered) neodymium iron boron (NeFeB) permanent magnet coated with nickel plating. Those skilled in the art will recognize that other magnets can be used.

Magnet 348 can comprise a substantially cylindrical shape with a circular cross section (as depicted) or, in embodiments, can comprise a different shape such as having a square, rectangular, or other shaped cross section. The magnetization direction of the magnets can be selected, such that an attractive force of the magnets of one permanent magnet presented with a first banner stand can magnetically cooperate with a second permanent magnet presented with a second, adjacent banner stand. Further details of magnets that can be used with embodiments are described in International Publication WO 01/35381, which is incorporated herein by reference in its entirety. Incorporation by reference is limited such that no subject matter is incorporated that is contrary to the explicit disclosure herein and any definitions provided in the documents are not incorporated by reference herein unless expressly included herein.

Figure 35:
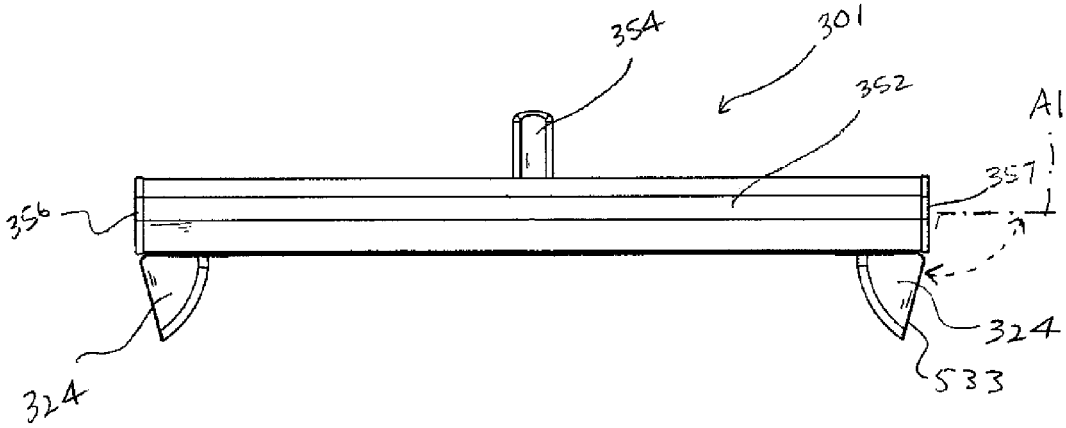
FIG. 35 is a top plan view of a base assembly of the retractable banner stands of FIG. 31.
Figure 36:
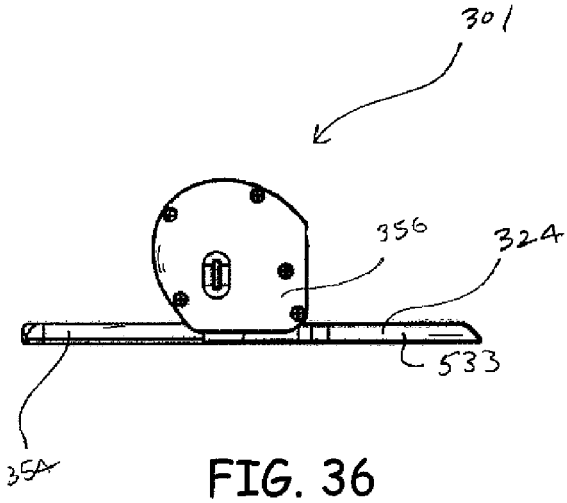
FIG. 36 is a side elevational view of the base assembly of FIG. 35.
Figure 37:
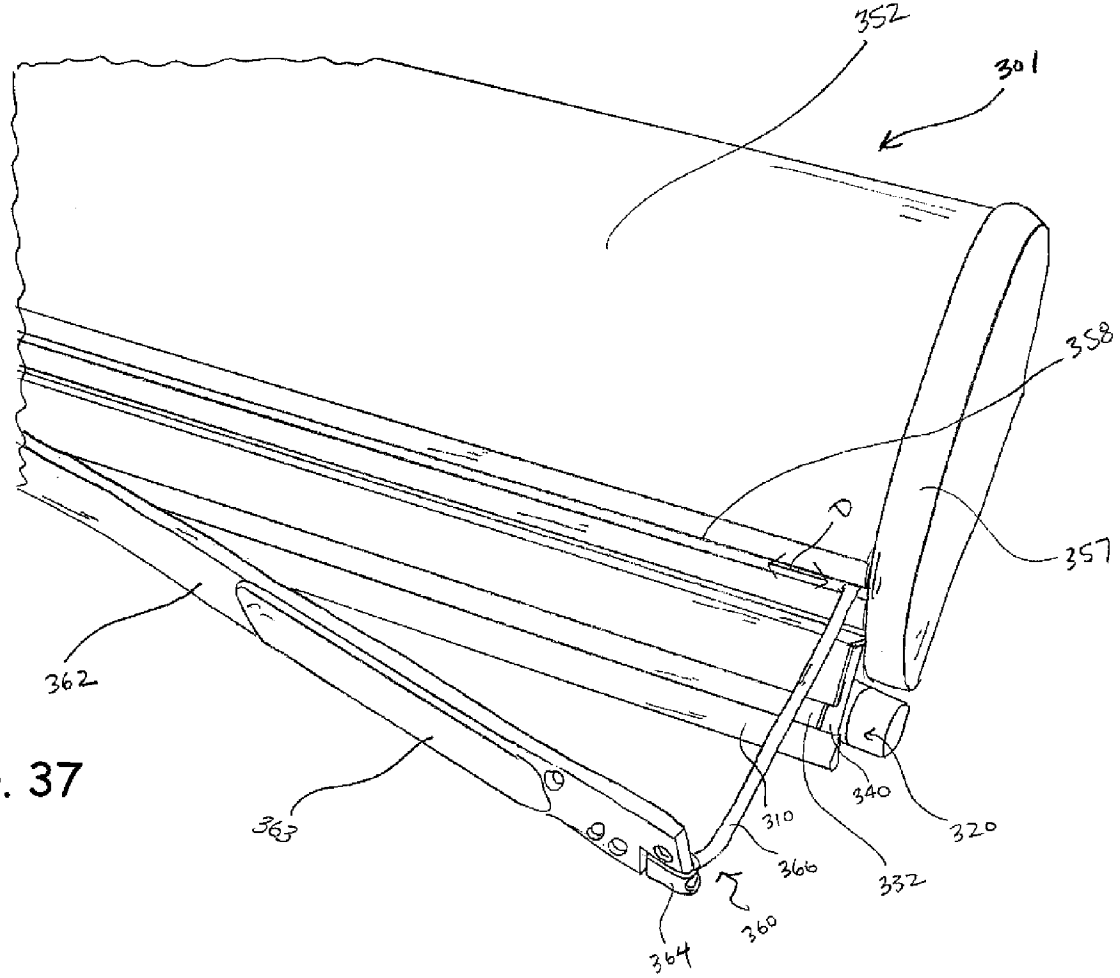
FIG. 37 is a close-up fragmentary view of the base assembly of FIG. 35 depicting a base strip in a curved configuration.
Figure 38:
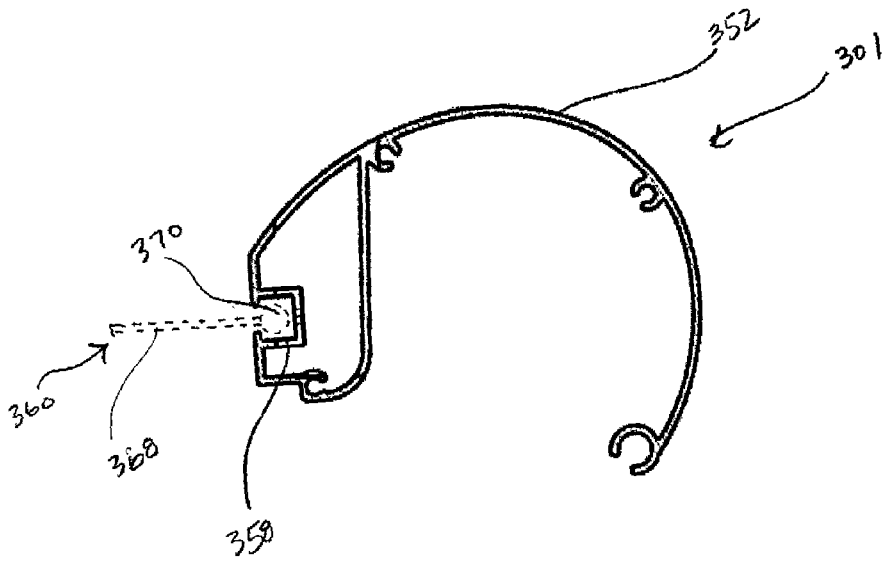
FIG. 38 is a cross-sectional view of a housing portion the base assembly of FIG. 37, wherein a spacer is depicted in phantom lines.

Referring to FIGS. 35 and 36, base 301 can comprise feet 324 on a front side thereof, a housing 352, and another foot 354 proximate a rear side thereof. Housing 352 can comprise a first end cap 356 and a second end cap 357 for selectively enclosing contents of housing 352, such as a retractor mechanism as described above. Referring to FIGS. 37 and 38, housing can further include a channel 358 along a length thereof.

Referring to FIGS. 37 and 38, second spacer mechanism 360 and second curved form 362 are depicted and described. Further, details of how curved form 362 can be selectively changed from a first configuration into the curved configuration to selectively impart a curve to the banner are described with reference to FIGS. 37 and 38. Curved form 362 can include a include a retaining member 363 or portion that inhibits the tendency of a banner on a banner stand with a curvature mechanism to bunch up towards the middle of the one or more curved forms. Such a retaining member is described in U.S. patent application Ser. No. 11/926,949, which is incorporated herein by reference in its entirety. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

Spacer mechanism 360 can comprise a hinge portion 364 and a spacer portion 366, spacer portion 366 comprising an elongate member 368 and a ball 370 (FIG. 38) or other end portion at an end of elongate member 368. Ball 370 is selectively slidable in channel 358 to enable curved form 362 to be selectively changed from a first configuration into the curved configuration. FIG. 37 also depicts curved form 315, cross member 332, banner 308, and magnet assembly 302 when in a retracted configuration.

Figure 39:
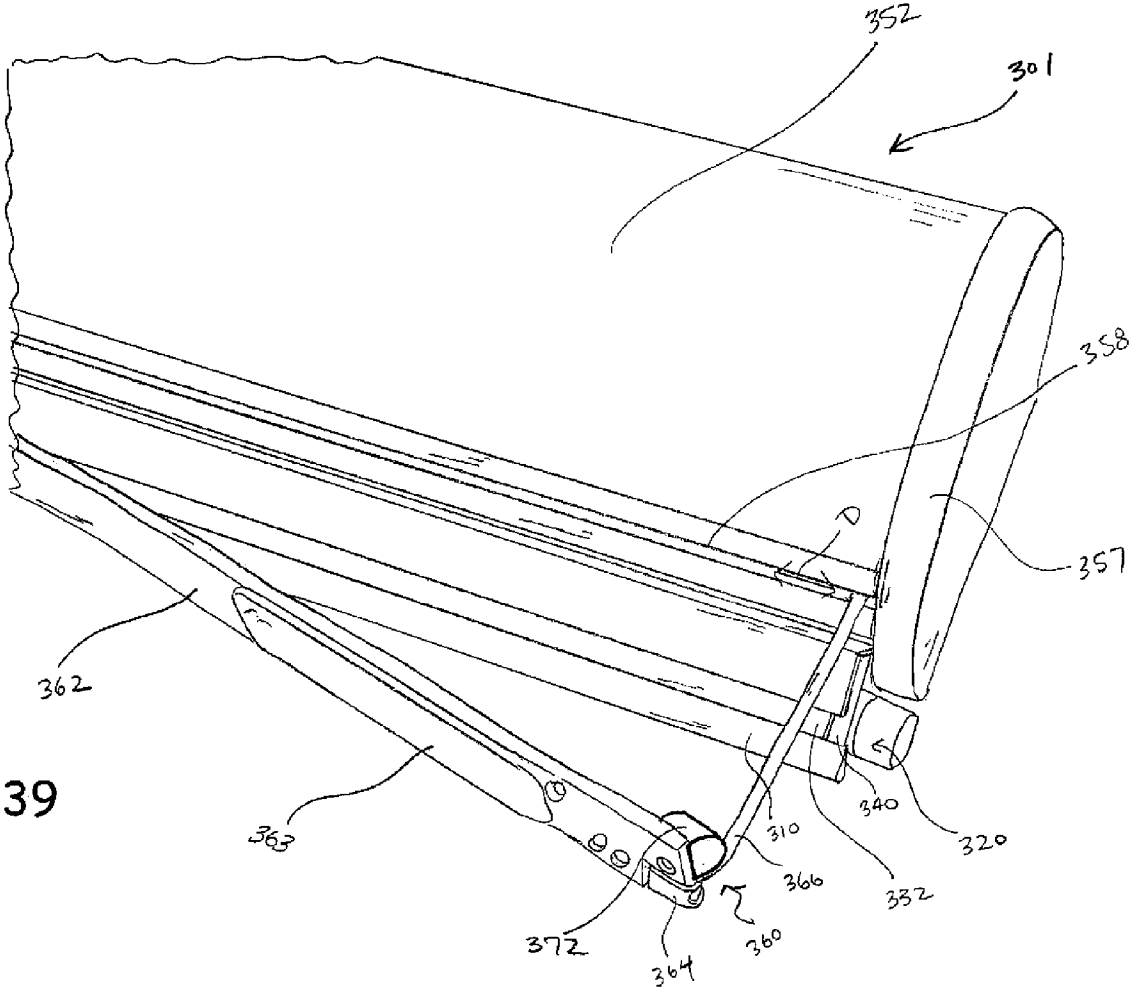
FIG. 39 is a close-up fragmentary view of the base assembly of FIG. 37 further including a magnet assembly presented therewith.

Referring to FIG. 39, in embodiments, curved form 362 can further include a magnet assembly 370 presented at an end of curved form 362. Magnet assembly 370 can be configured for selectively magnetically coupling a first banner stand with a second banner stand when placed adjacently thereto.

Referring to FIGS. 31-33, 41, 42 a method of providing tradeshow display 300 and instructions therefor can include providing banner stand 304 including banner 310 presenting graphics 311 thereon, base 303 and a post (not depicted) extending upwardly from base 303, support member 332 (FIG. 32) selectively operably coupleable with post (not depicted) to support banner 310 in an upright display mode, curved form 315 selectively changeable from a first configuration into a curved configuration to selectively impart a curve to banner 310 when banner 310 is in the upright display mode and one of magnets 320 configured for selectively magnetically coupling banner stand 304 with another banner stand 302 when placed adjacently thereto.

Instructions can be provided to selectively change curved form 315 from the first, uncurved configuration into the curved configuration to selectively impart the curve to banner 310 when banner 310 is in said upright display mode and selectively place banner stand 304 adjacently to banner stand 302, such that banner stands 304, 302 are magnetically coupled with magnet.

In an embodiment, banner stand 304 further includes another of magnets 320 configured for selectively magnetically coupling banner stand 304 with yet another banner stand 306 when placed adjacently thereto, the method further including providing instructions to selectively place banner stand 304 adjacently to banner stand 306, such that banner stands 304, 306 are magnetically coupled.

Referring to FIG. 40, a trade show display 400 is depicted wherein the banners are in an uncurved configuration. In this embodiment, trade show display 400 comprises first, second, and third retractable banner stands 402, 404, 406 arranged in series. Banner stands 402, 404, 406 have respective bases 401, 403, 405 and respective first, second, and third banners 408, 410, 412 optionally having graphics thereon. Banners 408, 410, 412 can each include a pair side margins 409, 411, 413, respectively.

Each of banners 408, 410, 412 comprises one or more magnets 318, 320, 322, respectively, extending beyond side margins 409, 411, 413. Magnets 318, 320, 322 are configured for selectively magnetically connecting adjacent banner stands. When banner stand 402 is magnetically coupled with banner stand 404 (and likewise banner stand 404 with banner stand 406), one of pair of opposed side margins 409 of banner 408 is maintained adjacent to and at a predetermined distance D from one of pair of opposed side margins 411 of banner 410 to create a visibly-recognizable separation between banner 408 and banner 410 (and likewise between banner 410 and banner 412). Referring again to FIG. 40 one of magnets 418 extends beyond one of side margins 409 by a first distance d and one of magnets 420 extends beyond one of side margins 411 by a second distance d', such that predetermined distance D is substantially a sum of first and second distances d, d'.

Figure 45:
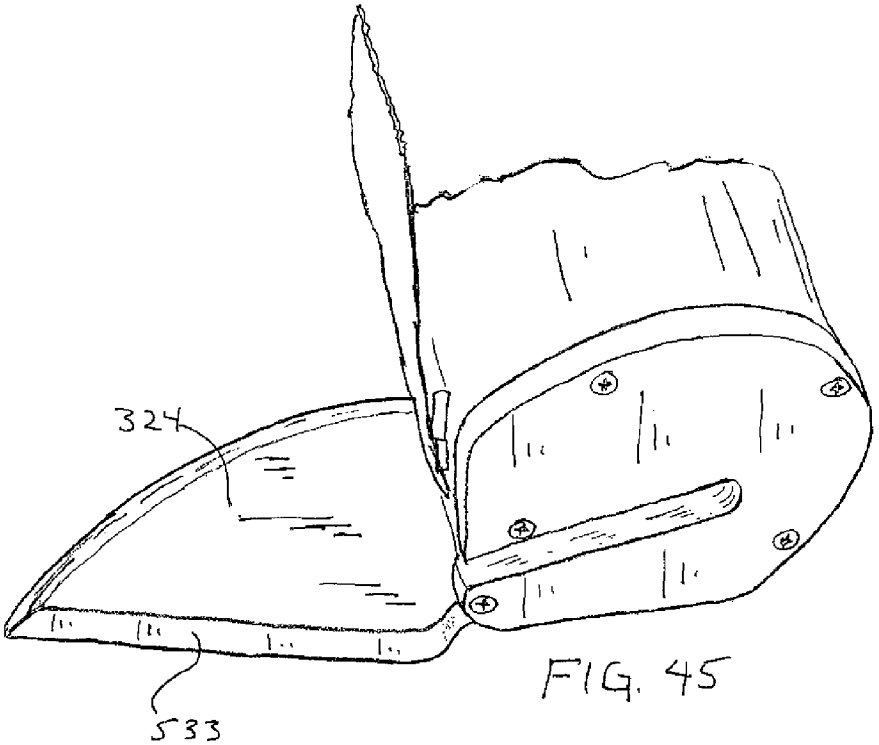
FIG. 45 is an end perspective view of an end foot and housing, the view from the opposite side being a mirror image thereof.
Figure 46:
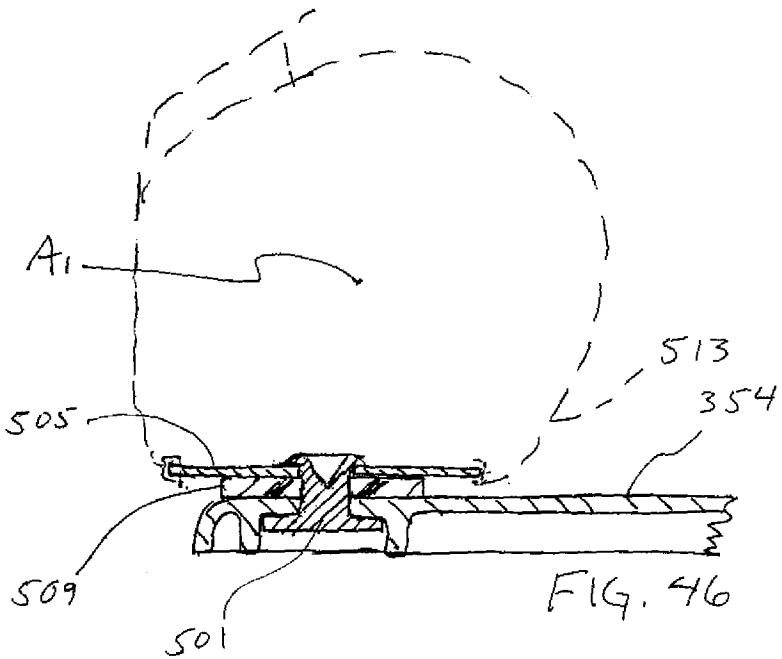
FIG. 46 is a cross sectional view showing a suitable attachment of the pivoting feet.

Referring to FIGS. 31, 35, 36, 41, 42, 43, 44, and 45, details relating to a positional and angular control means are illustrated. The end feet 324, which may be die cast aluminum, are illustrated as being pivotally attached to the housing as best illustrated in FIG. 45. The pivot piece 501 may suitably be a rivet attached to a rectangular steel plate 505 with a plastic low friction washer 509 therebetween. The plate is suitably attached to the housing 513 in a slot or by other suitable means. The feet have a transport position 517 shown in broken lines in FIG. 43 and an operative position 519 and are manually rotatable therebetween. Suitable stops 527 may be provided on the feet or housing to fix the limits of rotation.

Figure 41:
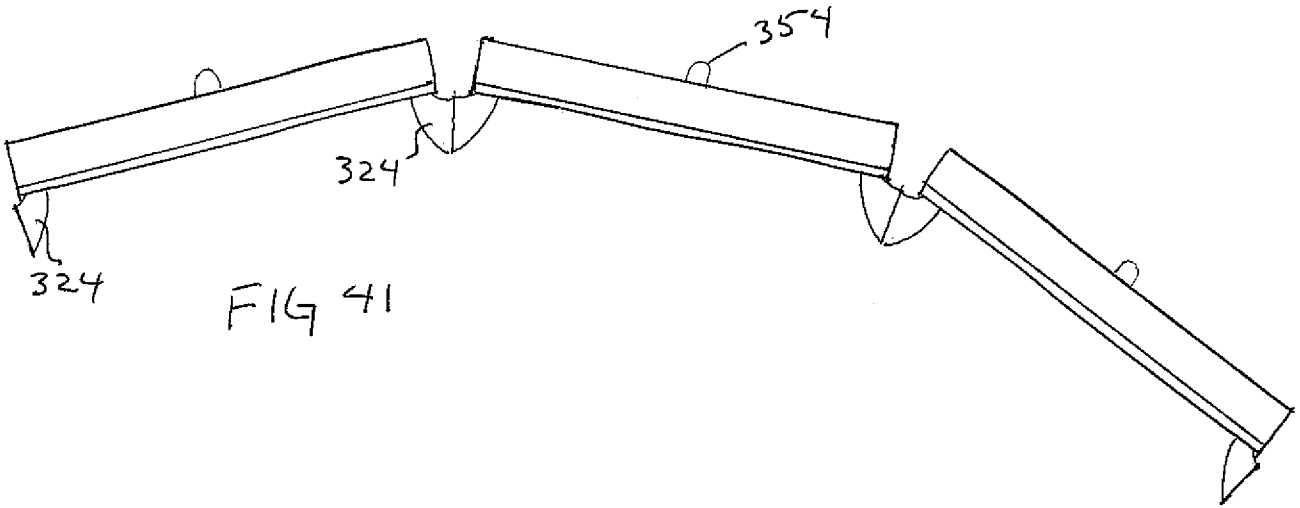
FIG. 41 is a top plan view of three banner stands in an engaged arrangement with positional and angular control provided by the end feet.
Figure 42:
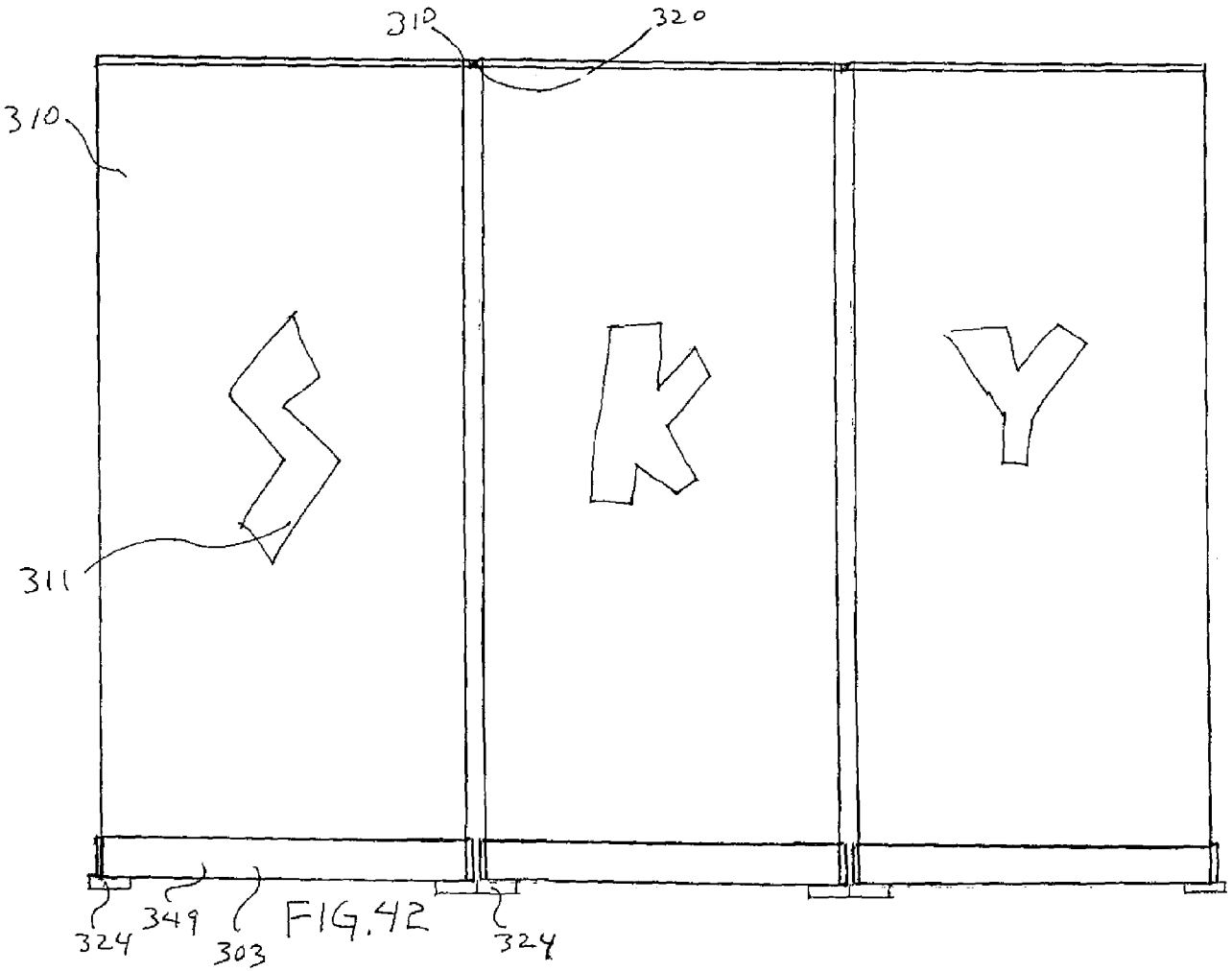
FIG. 42 is a front elevation view of three banner stands in an engaged arrangement with controlled banner spacing and angular position control.
Figure 43:
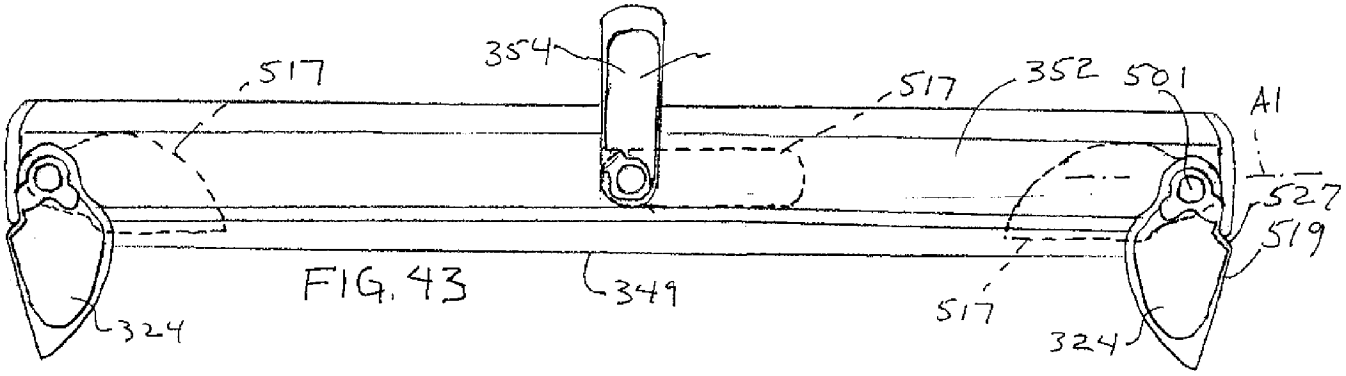
FIG. 43 is a bottom view of a banner stand base or housing with pivotal feet.
Figure 44:
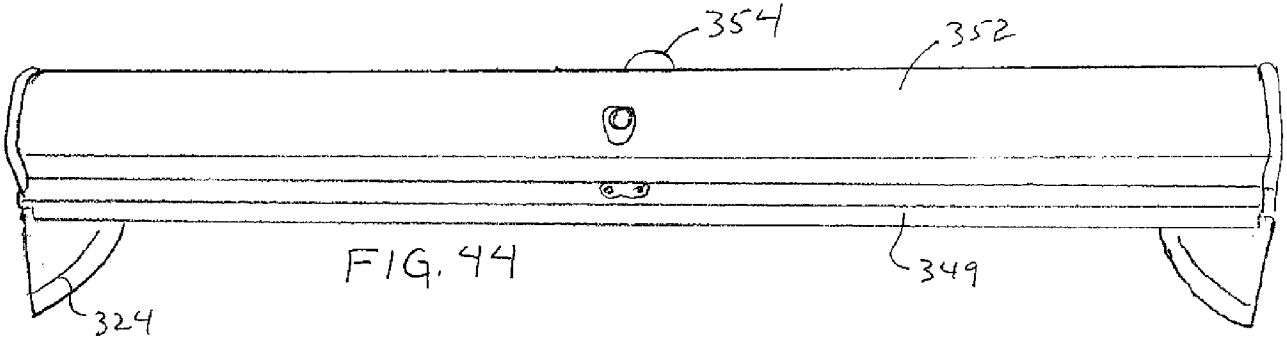
FIG. 44 is a top perspective view of the housing of FIG. 43.

The end feet 324 have an alignment surface 533 which is generally in a vertical plane and extends horizontally. The end feet are preferably positioned to provide a desired angular position between two like configured banner stands as is best illustrated in FIGS. 31 and 41. The angle α between the base or housing axis Al may be provided by the stop 527 engaging the housing. Angle α is preferably greater than 90 degrees and less than 135 degrees whereby an aesthetically pleasing angular position between adjacent banner stands is provided when the two alignment surfaces 533 of adjacent banner stands are abutted. Moreover, the positioning of the end feet and respective alignment surface are configured to provide an aesthetically desireable spacing between the respective banners of adjacent coupled banner stands. In a preferred embodiment this spacing is at least about 1 inch. In a preferred embodiment this spacing is at least about ½ inch. In a preferred embodiment this spacing is at least about 2 inchs. In a preferred embodiment this spacing is within at least about ½ inch and less than about 5 inches. The spacing provided by the engagement of the feet is appropriately complementary and consistent with the spacing provided by the coupling at the top of the banner stands, most suitably by magnets. Other coupling such as hook and loop material (Velcro®) or simple mechanical connections would also be suitable. Notably, the positional and angular control means as presented is advantageous for banner stands that have curvature capabilities as well as conventional uncurved banners.

In an embodiment, not illustrated, means may be provided to provide adjustability to the rotational stop setting the angle α. In certain embodiments the feet may be removable, such as when in the transport position, and may be placed on the housing at a set desired angle for the operative position. Although the figures with the rotatable feet utilize two end feet extending forwardly and a centrally positioned foot extending rearwardly, it is apparent that the end feet could be configured to extend forwardly and rearwardly when rotated to their operative position. Similarly the end feet could extend rearwardly exclusively when in their operative position and still have the alignment surface provide a desired angular position. In such a case the angle α measured from the axis A1 to the alignment surface would preferably be less than 90 degrees and greater than 45 degrees. A central foot would suitable be rotatable to a forward operative position. Also the alignment surfaces are illustrated as being planar but other configurations could be suitable including overlapping or interlocking arrangements, not illustrated, that could provide addition stability. Also coupling features could be provided at the end feet including magnets.

Referring to FIGS. 31, 35, 36, 41, 42, 43, 44, and 45, details relating to a positional and angular control means are illustrated. The end feet 324, which may be die east aluminum, are illustrated as being pivotally attached to the housing as best illustrated in FIG. 45. The pivot piece 501 may suitably be a rivet attached to a rectangular steel plate 505 with a plastic low friction washer 509 therebetween. The plate is suitably attached to the housing 513 in a slot or by other suitable means. The feet have a transport position 517 shown in broken lines in FIG. 43 and an operative position 519 and are manually rotatable therebetween. Suitable stops 527 may be provided on the feet or housing to fix the limits of rotation.

The end feet 324 have an alignment surface 533 which is generally in a vertical plane and extends horizontally. The end feet are preferably positioned to provide a desired angular position between two like configured banner stands as is best illustrated in FIGS. 31 and 41. The angle .alpha. between the base or housing axis Al may be provided by the stop 527 engaging the housing. Angle .alpha. is preferably greater than 90 degrees and less than 135 degrees whereby an aesthetically pleasing angular position between adjacent banner stands is provided when the two alignment surfaces 533 of adjacent banner stands are abutted, Moreover, the positioning of the end feet and respective alignment surface are configured to provide an aesthetically desirable spacing between the respective banners of adjacent coupled banner stands. In a preferred embodiment this spacing is at least about 1 inch. In a preferred embodiment this spacing is at least about ½ inch. In a preferred embodiment this spacing is at least about 2 inches. In a preferred embodiment this spacing is within at least about ½ inch and less than about 5 inches. The spacing provided by the engagement of the feet is appropriately complementary and consistent with the spacing provided by the coupling at the top of the banner stands, most suitably by magnets. Other coupling such as hook and loop material (Velcro.RTM.) or simple mechanical connections would also be suitable. Notably, the positional and angular control means as presented is advantageous for banner stands that have curvature capabilities as well as conventional uncurved banners.

In embodiment, not illustrated, means may be provided to provide adjustability to the rotational stop setting the angle .alpha.. In certain embodiments the feet may be removable, such as when in the transport position, and may be placed on the housing at a set desired angle for the operative position. Although the figures with the rotatable feet utilize two end feet extending forwardly and an centrally positioned foot extending rearwardly, it is apparent that the end feet could be configured to extend forwardly and rearwardly when rotated to their operative position. Similarly the end feet could extend rearwardly exclusively when in their operative position and still have the alignment surface provide a desired angular position. In such a case the angle .alpha. measured from the axis A1 to the alignment surface would preferably be less than 90 degrees and greater than 45 degrees. A central foot would suitable be rotatable to a forward operative position. Also the alignment surfaces are illustrated as being planar but other configurations could be suitable including overlapping or interlocking arrangements, not illustrated, that could provide addition stability. Also coupling features could be provided at the end feet including magnets.

The embodiments above are intended to be illustrative and not limiting. Additional embodiments are within the claims. In addition, although the present invention has been described with reference to particular embodiments, those skilled in the art will recognize that changes can be made in form and detail without departing from the spirit and scope of the invention. For purposes of the present disclosure, incorporation by reference of any reference, patent or published application is deemed to be limited such that no subject matter is incorporated that is contrary to the explicit disclosure herein and any definitions provided in the documents are not incorporated by reference herein unless expressly included herein.

What is claimed is:

1. A retractable banner stand having an erected upright mode and a collapsed transport mode, the banner stand comprising:

a banner formed of a flexible sheet material for suspending in a substantially upright open position, the banner having graphics thereon;

a base comprising a housing and a core in the housing for winding the banner thereon and a retracting mechanism for unwinding and winding the banner with respect to the core, the base further comprising feet for engaging a floor or table surface;

a post extending upwardly from the housing;

a cross member presented with the post to support the banner when the banner is unwound from the housing; and a curved form positioned at the base and a curved form positioned at the cross member to each impart a curvature to the banner when the banner is in the erected upright mode, the curvature extending continuously from the curved form at the base to the curved form at the cross member.

2. The retractable banner stand of claim 1 wherein each curved form is comprised of a resiliently flexible elongate member resiliently flexible between a first configuration and a curved configuration.

3. The retractable banner stand of claim 2 wherein each resiliently flexible elongate member has a cross-section with a greater dimension in a first plane and a lesser dimension in a second plane perpendicular to the first plane and wherein the greater dimension is at least four times the lesser dimension whereby the length is more readily flexible in the plane of the lesser dimension and wherein the plane of the lesser dimension is substantially horizontal when the retractable banner stand is erected.

4. A retractable banner stand comprising:

a banner formed of a flexible sheet material for extending in a substantially upright and open position, the banner having graphics thereon;

a base for positioning the banner stand on one of a floor and table surface;

a core for winding the banner thereon and a retracting mechanism for unwinding and winding the banner with respect to the core;

an upright member extending upwardly to a cross member, the cross member presented with the upright to support the banner when the banner is unwound from the core; and a curved form providing curvature in the horizontal plane to the banner when the banner is extended in the substantially upright and open position.

5. The retractable banner stand of claim 4 wherein when the banner is substantially upright and open it has a top and a bottom, and wherein the banner stand comprises a further curved form, and wherein one curved form is engaged at the bottom of the banner and one curved form is engaged at the top of the banner.

6. The retractable banner stand of claim 4 wherein each curved form comprises an elongate member that is resiliently flexible for selectively providing curvature to the banner.

7. The retractable banner stand of claim 5 where the curved form has a fixed curved surface insertable into engagement with the banner.

8. The retractable banner stand of claim 4, wherein the curved form comprises a first curved form engageable with the banner adjacent the base, and wherein the banner stand further comprises a second curved form engageable with the banner at a top of the banner when the banner is fully extended and upright.

9. A first and a second banner stand for placement adjacent to each other, each banner stand having an upright display mode and a collapsed transport mode, each banner stand comprising:

a banner presenting graphics thereon;

a base with a longitudinal axis comprising a housing and a core for winding the banner thereon; and a post extending upwardly; and a support member coupleable with said post to support said banner in an upright display mode;

the base having a longitudinal axis and a pair of opposing ends, each of said bases having an outwardly facing alignment surface selectively deployable between an extended configuration and a retracted configuration and when said outwardly facing alignment surface of the first banner stand is engaged against the alignment surface of the base of the second banner stand, an angular positioning between the first and second banner stands is presented such that an obtuse angle is presented between the longitudinal axes of said first and second banner stands.

10. The first and second banner stands of claim 9 wherein the respective outwardly facing alignment surfaces provide a spacing between the banners of the first and second banner stands.

11. The first and second banner stands of claim 9 wherein the banner of each banner stand when in the upright display mode is substantially upright and open has a top and a bottom, and wherein each banner stand comprises a curved form, and wherein one curved form is engaged at the bottom of the banner and one curved form is engaged at the top of the banner for providing a continuous curvature from the top of each banner to the bottom of each said banner.

12. The first and second banner stands of claim 11 wherein each base comprises a foot and each of the alignment surfaces are part of the respective foot.

13. The first and second banner stands of claim 12 wherein each foot has a retracted position for transport and an extended position for use.

14. The first and second banner stands of claim 9, wherein each outwardly facing alignment surface is selectively adjustable such that in the extended configuration when the alignment surface of the first banner stand is engaged against the alignment surface of the base of the second banner stand a plurality of different obtuse angles can be presented between the longitudinal axes of said first and second banner stands.

15. The first and second banner stands of claim 14, wherein the alignment surfaces are rotatably adjustable to provide the plurality of obtuse angles.

* * * * *